US005897961A

United States Patent [19]

Malhotra et al.

[11] Patent Number: 5,897,961

[45] Date of Patent: Apr. 27, 1999

[54] COATED PHOTOGRAPHIC PAPERS

[75] Inventors: Shadi L. Malhotra; Kirit N. Naik, both of Mississauga, Canada

[73] Assignee: Xerox Corporation, Stamford, Conn.

[21] Appl. No.: 08/852,776

[22] Filed: May 7, 1997

[51] Int. Cl.[6] ..... B41M 5/00

[52] U.S. Cl. ..... 428/537.5; 428/195; 428/211; 428/535

[58] Field of Search ..... 428/195, 211, 428/537.5, 535; 347/105

[56] References Cited

U.S. PATENT DOCUMENTS

| | | | |
|---|---|---|---|
| 3,154,461 | 10/1964 | Johnson | 161/116 |
| 3,790,435 | 2/1974 | Tanba et al. | 161/160 |
| 4,154,664 | 5/1979 | Renevot | 204/195 |
| 4,500,607 | 2/1985 | Louden et al. | 428/511 |
| 4,663,216 | 5/1987 | Toyoda et al. | 428/212 |
| 4,705,719 | 11/1987 | Yamanaka et al. | 428/323 |
| 4,734,336 | 3/1988 | Oliver et al. | 428/537.5 |
| 4,741,969 | 5/1988 | Hayama et al. | 428/514 |
| 4,770,934 | 9/1988 | Yamasaki et al. | 428/331 |
| 4,795,676 | 1/1989 | Maekawa et al. | 428/328 |
| 4,868,581 | 9/1989 | Mouri et al. | 346/1.1 |
| 4,887,097 | 12/1989 | Akiya et al. | 346/135.1 |
| 4,903,039 | 2/1990 | Light | 346/1.1 |
| 4,903,040 | 2/1990 | Light | 346/1.1 |
| 4,903,041 | 2/1990 | Light | 346/1.1 |
| 5,053,268 | 10/1991 | Ehara et al. | 428/215 |
| 5,075,153 | 12/1991 | Malhotra | 428/207 |
| 5,101,218 | 3/1992 | Sakaki et al. | 346/1.1 |
| 5,141,599 | 8/1992 | Jahn et al. | 162/137 |
| 5,223,338 | 6/1993 | Malhotra | 428/342 |
| 5,281,467 | 1/1994 | Shimada et al. | 428/195 |
| 5,302,249 | 4/1994 | Malhotra et al. | 162/135 |
| 5,314,747 | 5/1994 | Malhotra et al. | 428/341 |
| 5,320,902 | 6/1994 | Malhotra et al. | 428/342 |
| 5,354,813 | 10/1994 | Farooq et al. | 525/326.7 |
| 5,372,884 | 12/1994 | Abe et al. | 428/331 |
| 5,379,619 | 1/1995 | Young | 70/202 |
| 5,403,955 | 4/1995 | Farooq | 564/15 |
| 5,441,795 | 8/1995 | Malhotra et al. | 428/195 |
| 5,457,486 | 10/1995 | Malhotra et al. | 347/105 |
| 5,561,454 | 10/1996 | Kurabayashi et al. | 347/105 |
| 5,567,513 | 10/1996 | Takeuchi et al. | 428/331 |
| 5,569,529 | 10/1996 | Becker et al. | 428/331 |
| 5,605,750 | 2/1997 | Romano et al. | 428/304.4 |

FOREIGN PATENT DOCUMENTS

| | | |
|---|---|---|
| 0 671 282 | 9/1995 | European Pat. Off. . |
| 0 673 781 | 9/1995 | European Pat. Off. . |
| 0 673 784 | 9/1995 | European Pat. Off. . |

*Primary Examiner*—Bruce H. Hess
*Attorney, Agent, or Firm*—E. O. Palazzo

[57] ABSTRACT

A coated ink jet paper with (1) a cellulosic substrate, (2) a first ink receiving coating on the front side of the substrate capable of absorbing an ink vehicle, and which receiving layer coating is comprised of (a) a hydrophilic binder polymer, (b) an ink wetting/ink spreading agent, (c) a dye mordant, (d) a lightfastness agent, (e) a filler, (f) a biocide; and (3) a second traction controlling coating in contact with the reverse side of the substrate, and which coating is comprised of a polymer with a glass transition temperature of from between about a negative −50° C. to about 50° C., a lightfastness agent, an antistatic agent, a pigment, and a biocide. The cellulosic substrate can be comprised of alkaline sized and acid sized blends of hardwood kraft and softwood kraft fibers, which blends contain from about 20 percent to 80 percent by weight of softwood and from about 80 to about 20 percent by weight of hardwood. The sizing value of the cellulosic substrate varies between 50 seconds to 500 seconds, the porosity varies from 100 to 600 mil/minute, and the thickness varies between 50 microns to 250 microns.

25 Claims, No Drawings

COATED PHOTOGRAPHIC PAPERS

PENDING APPLICATIONS AND PATENTS

Illustrated in copending applications U.S. Ser. No. 852,553; U.S. Ser. No. 852,550; U.S. Pat. No. 5,846,637; and U.S. Pat. No. 5,746,814, the disclosures of which are totally incorporated herein by reference, are coated substrates and methods, recording sheets, coated xerographic photographic papers, and decurling compositions, respectively.

U.S. Pat. No. 5,663,004, the disclosure of which is totally incorporated herein by reference, discloses a recording sheet which comprises a substrate, an image receiving coating, and a biocide. More specifically, this copending application discloses a recording sheet which comprises (a) a substrate comprising a first paper ply, a second paper ply, and, situated between the first and second plies, a hydrophobic adhesive layer; (b) an image receiving coating situated on at least one surface of the substrate, said image receiving coating being suitable for receiving images of an aqueous ink and suitable for receiving images of an electrostatic toner composition, the coating comprising (1) a polymeric binder, (2) a dye fixative, and (3) an optional pigment.

Copending application U.S. Ser. No. 08/075,435 now abandoned, the disclosure of which is totally incorporated herein by reference, discloses a recording sheet which comprises a base sheet and a coating mixture comprising (a) a latex binder; (b) a desizing agent; (c) a dye fixative; (d) an optional pigment; and (e) an optional nonlatex cobinder.

U.S. Pat. No. 5,768,809, the disclosure of which is totally incorporated herein by reference, discloses a recording sheet which comprises a base sheet, a phosphonium compound, an optional pigment, and an optional binder.

BACKGROUND OF THE INVENTION

The present invention is directed to coated photographic papers, that is for example coated papers containing a supporting substrate derived from natural cellulose, and possessing the appearance of a photographic base paper, and with certain coatings thereover and thereunder, and the use of these papers in ink jet printing processes, in xerographic imaging systems, and digital imaging processes, and wherein there is provided, for example, developed images that simulate, for example, silver halide and the like photographs. More specifically, the present invention is directed to photographic papers capable of recording clear, brilliant, glossy images with, for example, an optical density between about 1.5 and about 2.0 for a black ink, between about 1.2 to about 1.6 for a cyan ink, between about 1.1 to about 1.4 for a magenta ink, and between about 0.85 to about 1.0 for a yellow ink, and with lightfastness values of greater than about 95 percent, that is for example from about 95 to about 99.5 percent, for all the aforementioned inks, waterfastness values greater than about 90 percent, for example from about 90 to about 95 percent, for the inks and low edge raggedness values of about 0.25 millimeter (between black and yellow), about 0.30 millimeter (between cyan and yellow), about 0.30 millimeter (between magenta and yellow), and about 0.45 millimeter (between magenta and cyan), and which papers are comparable in look and feel to conventional color photograph prints. The coated papers can be prepared from papers containing an ink receiving layer on the front side of the paper and a traction promoting pencil or pen writeable coating on the back side, reverse, or opposite side of the ink jet photographic paper. One embodiment of the present invention is directed to ink jet printable coated papers comprised of (1) a substrate such as paper, (2) a first ink receiving coating on the front side of the paper capable of absorbing the ink vehicle and comprised of a hydrophilic binder, an ink wetting agent, a flavor imparting compound, a lightfastness agent, a dye mordant and a filler; and (3) a second traction promoting coating in contact with the back, or reverse side of the photographic paper, and which coating is comprised of at least one, for example from 1 to about 10, from 1 to about 5, and preferably 1 component selected from polymers with a glass transition temperature of between about a minus −50° C. to about a plus 50° C. (Centigrade throughout), and preferably from about −40° C. to +25° C., such as a polyester latex, a styrene-butadiene latex and the like, and a filler such as zirconium oxide, microspheres, and the like.

PRIOR ART

U.S. Pat. No. 3,154,461 discloses polymeric film structures having a matte-finish and a cellular structure achieved with the addition of fillers which roughens the surface upon stretching of the films and renders them receptive to marking by crayons, pencil and ball-point pen.

Disclosed in U.S. Pat. No. 3,790,435 are synthetic papers with acceptable foldability of a nonlaminated structure of one thermophotographic resin film or a laminated structure of at least two thermophotographic resin films. Each of the films are stretched or molecularly oriented, and one or more of the films contain a fine inorganic filler to provide paperness of the film. According to this patent, some of the films may contain certain amounts of poly(styrene) as a foldability improving agent.

U.S. Pat. No. 4,154,664 discloses a recording medium which has a recording surface having a 60 (specular gloss of at least 30 percent according to JIS Z8741, and a Munsell lightness of at least 7.5 according to JIS Z8721. The recording medium may comprise an ink-receiving layer formed thereon. A recording method is also provided which employs the above mentioned recording medium.

U.S. Pat. No. 4,500,607 discloses a paper which resists significant distortion in planarity in response to moisture which comprises a web which carries a predetermined amount of a polymer-filler blend and which has been dried after application of said blend to a finished moisture level below about 4 percent by weight.

There is disclosed in U.S. Pat. No. 4,663,216 a synthetic paper printable in high gloss, and comprised of a (1) multilayer support, (2) a layer of a transparent film of a thermophotographic resin free from an inorganic fine powder formed on one surface of the support (1) and (3) a primer layer of a specific material, reference the Abstract of the Disclosure for example. The support (1) comprises (1a) a base layer of a biaxially stretched film of a thermophotographic resin, a surface and a back layer (1b), and (1c) composed of a monoaxially stretched film of a thermophotographic resin containing 8 to 65 percent by weight of an inorganic fine powder.

Also, there is disclosed in U.S. Pat. No. 4,705,719 a synthetic paper of multilayer resin film comprising a base layer (1a) of a biaxially stretched thermophotographic resin film, and a laminate provided on at least one of opposite surfaces of said base layer, the laminate including a paper-line layer (1b) and a surface layer (1c), the paper like layer containing a uniaxially stretched film of thermophotographic resin containing 8 to 65 percent by weight of inorganic fine powder, the surface layer being comprised of a uniaxially stretched film of a thermophotographic resin.

U.S. Pat. No. 4,734,336, the disclosure of which is totally incorporated herein by reference, discloses a twin ply uncoated paper for ink jet processes, which paper comprises a supporting paper substrate sheet as a first ply, and thereover as a second ply a paper sheet with filler additives attached to the fibers thereof, which additives include, for example, amorphous synthetic silicas, inorganic silicates, metal alumino-silicates, or inorganic oxides. Three ply papers are also illustrated wherein there is situated between two second plies a supporting substrate sheet.

In U.S. Pat. No. 4,741,969, there is disclosed an aqueous ink recording sheet which is prepared by coating on the surface of a substrate sheet a resin composition containing as the main ingredient a mixture comprising (A) 10 to 90 percent of a photopolymerizable double bonded anionic synthetic resin, and (B) 90 to 0 weight percent of partially or completely saponified polyvinyl alcohol, or partially or completely saponified polymer resin composed of 20 to 100 weight percent of vinyl acetate and 80 to 0 weight percent of a polymerizable monomer or derivatives thereof, and/or (C) 90 to 0 weight percent of homopolymer resin of N-vinylpyrrolidone or copolymer resin of other polymerizable monomer therewith, with the weight ratio of (A)/(B)+(C) being 90/10 to 10/90, drying the coated resin composition by irradiation with actinic rays so as to form a resin coating layer on the substrate.

Also, there is disclosed in U.S. Pat. No. 4,770,934 an ink jet recording medium having at least one ink receptive layer containing synthetic silica of fine particle form as a main pigment having a recording surface dried by pressing said recording surface against a heated mirror surface, and having ink receptive layer having an absorption capacity of at least 10 g/m$^2$. Also known is an electrostatic recording material comprised of a multi-layered sheet support having an electroconductive layer and dielectric layers formed thereon, reference for example U.S. Pat. No. 4,795,676.

In U.S. Pat. No. 4,868,581 there is disclosed an opaque paper-based receiving material for ink jet printing which comprises a poly(olefin)-coated paper overcoated with an ink-receiving layer which contains a mixture of gelatin and starch. Reportedly, these receiving materials exhibit high gloss, excellent, color density and are smudge resistant. Although the receiving materials, when pictorially imaged with an ink jet printing device, produce images that approach conventional photographic prints in appearance and feel, the images that are produced thereon are still not of the same high quality that is customarily expected from and exhibited by photographic prints. With the present invention papers, as compared to this prior art, there is enabled a number of advantages as illustrated herein, and more specifically, images with excellent resolution and extended lifetimes.

In U.S. Pat. No. 4,887,097, there is disclosed a recording medium having a substrate and an ink receiving layer provided on said substrate, wherein said ink receiving layer contains, in combination, solvent soluble resin (A) that is capable of absorbing water in an amount of 0.5 times or more as much as its own weight and is substantially water insoluble, and particles of solvent-insoluble resin (B) that is capable of absorbing water in an amount of 50 times or more as much as its own weight.

Also, there is disclosed in U.S. Pat. No. 4,903,039 an opaque paper-based receiving material for ink jet printing which comprises a poly(olefin)-coated paper overcoated with an ink-receiving layer which contains an aqueous dispersion of a polyester ionomer, namely a poly [cyclohexylenedimethylene-co-oxydiethylene isophthalate-co-malonate-copolydiosulfobenzenedicarboxylate], dispersed in vinyl pyrrolidone polymer.

Further, there is disclosed in U.S. Pat. No. 4,903,040 an opaque paper-based receiving material for ink jet printing which comprises a poly(olefin)-coated paper overcoated with an ink-receiving layer which contains an aqueous dispersion of a polyester ionomer, namely a poly [cyclohexylenedimethylene isophthalate-co-sodiosulfobenzene dicarboxylate], dispersed in vinyl pyrrolidone polymer.

Moreover, there is disclosed in U.S. Pat. No. 4,903,041 an opaque paper-based receiving material for ink jet printing which comprises a poly(olefin)-coated paper overcoated with an ink-receiving layer which contains an aqueous dispersion of a polyester ionomer, namely a poly [cyclohexylenedimethylene-co-xylyleneterephthalate-co-malonate-co-sodioiminobis(sulfonylbenzoate], dispersed in vinyl pyrrolidone polymer.

U.S. Pat. No. 5,053,268, the disclosure of which is totally incorporated herein by reference, discloses a composite paper suitable for use as writing paper, printing paper or copying paper which includes a synthetic resin film having a thickness of 12 to 30 microns, and a paper sheet laminated on each side of the synthetic resin film and having a Bekk smoothness of 60 to 120 seconds, a density of 0.8 to 1.0 g/cm$^3$, a degree of sizing of 0.5 to 1.5 seconds, and a thickness of 20 to 25 microns.

There is disclosed in U.S. Pat. No. 5,075,153 a never-tear paper comprised of a photographic supporting substrate, a binder layer comprised of polymers selected from the group consisting of (1) hydroxy propyl cellulose, (2) poly(vinyl alkylether), (3) vinylpyrrolidone/vinylvinylacetate, (4) quaternized vinyl pyrrolidone/dialkylaminoethyl/methacrylate, (5) poly(vinylpyrrolidone), (6) poly(ethylene imine), or mixtures thereof; and a pigment, or pigments; and an ink receiving polymer layer.

There is disclosed in U.S. Pat. No. 5,101,218 a recording medium comprising a substrate and a non-porous ink receiving layer provided thereon, said ink receiving layer comprising (1) a water-insoluble polymer that is a crosslinked product of a water soluble polymer, and (2) a cationic resin of 2 to 30 percent by weight based on the water-insoluble polymer, said recording medium having a linear transmittance of at least 10 percent.

Moreover, there is disclosed in U.S. Pat. No. 5,141,599 a receiving material for ink-jet printing that includes a polyolefin coated base paper and an ink receiving layer applied on the front face thereof, and wherein the receiving layer contains a mixture of gelatin and starch.

U.S. Pat. No. 5,223,338, the disclosure of which is totally incorporated herein by reference, discloses a recording sheet which comprises a substrate and a coating consisting essentially of quaternary ammonium polymers.

Also, there is disclosed in U.S. Pat. No. 5,281,467 an ink jet recording paper having a support provided on at least one surface with a pigment-containing coating prepared in accordance with cast coating methods, with said pigment comprising at least 50 weight percent of a calcium carbonate-compounded silica, whereby achieving excellent ink absorption, smoothness, gloss and water resistance together with an excellent dot density, sharpness and roughness to ensure recording of high quality, high contrast full color images.

U.S. Pat. No. 5,302,249, the disclosure of which is totally incorporated herein by reference, discloses a paper comprising a supporting substrate with a coating which comprises a desizing component and a hydrophilic polymer. In an embodiment, the paper comprises a supporting substrate treated with desizing agents such as hydrophilic poly (dialkylsiloxanes).

U.S. Pat. No. 5,314,747, the disclosure of which is totally incorporated herein by reference, discloses a recording sheet which comprises (a) base sheet; (b) a cationic sulfur compound selected from the group consisting of sulfonium compounds, thiazolium compounds, benzothiazolium compounds, and mixtures thereof; (c) an optional binder; and (d) an optional pigment.

U.S. Pat. No. 5,320,902, the disclosure of which is totally incorporated herein by reference, discloses a recording sheet which consists essentially of a substrate and, in contact with the substrate, a monoammonium compound.

Mordants based upon poly(vinylpyridine), poly(N-vinylimidazoles), and poly(-meth)acrylates are disclosed in U.S. Pat. No. 5,354,813. The polymeric mordants contain N-heterocycles which are N-quaternized by different types of alkylated hydrazones, and multiple-quaternized alkylated salts serving as pendant groups.

Other mordants based upon a polyethyleneimine backbone and either pendant phosphonium or quaternized-nitrogen compounds are disclosed in U.S. Pat. No. 5,403,955.

There is disclosed in U.S. Pat. No. 5,372,884 an ink jet recording sheet comprising a support and an ink receiving layer provided on at least one side of the support wherein said ink receiving layer contains a cation-modified acicular or fibrous colloidal silica obtained by coating the surface of acicular or fibrous colloidal silica with a cation modifier, the coating amount of the cation-modifier being 1 to 30 percent by weight based on the weight of the acicular or fibrous colloidal silica, and the coating amount of the acicular or fibrous colloidal silica contained in the ink receiving layer being 2 to 100 g/m$^2$. The cation-modifier used is preferably hydrous aluminum oxide, hydrous zirconium oxide or hydrous tin oxide.

Also, there is disclosed in U.S. Pat. No. 5,397,619 an ink jet recording paper comprised of a base paper wherein at least one surface has a recording layer, this recording layer containing at least 40 weight percent of a pigment and no more than 60 weight percent of a binder, the surface roughness by ten point height on the recording layer being no more than 5 $\mu$m, and air permeability being no more than 1,000 seconds and a manufacturing process thereof are disclosed.

U.S. Pat. No. 5,441,795 the disclosure of which is totally incorporated herein by reference, discloses a recording sheet which comprises a base sheet and a material selected from the group consisting of pyridinium compounds, piperazinium compounds, and mixtures thereof.

U.S. Pat. No. 5,457,486 the disclosure of which is totally incorporated herein by reference, discloses a recording sheet which comprises (a) a base sheet; (b) a material selected from the group consisting of tetrazolium compounds, indolinium compounds, imidazolinium compounds, and mixtures thereof; (c) an optional pigment; and (d) an optional binder.

There is disclosed in U.S. Pat. No. 5,561,454 a recording medium having at least a pigment and a binder on the surface of a base, wherein the binder is comprised of at least water-soluble polyester. An ink jet recording method includes the step of performing recording on a recording medium by discharging ink from an orifice of an ink jet recording head in accordance with recording signals, wherein the recording medium has at least a pigment and a binder on the surface of the base, and wherein the binder is comprised of at least water-soluble polyester. The amount of the water soluble polyester is 40 percent or more with respect to the total weight of the binder.

U.S. Pat. No. 5,567,513 discloses an ink jet recording paper sheet for ink-jet recording with on-demand type heads having a multi-nozzle comprises a recording layer formed on one face of a base paper sheet to give a basis weight of the recording paper of from 150 to 250 g/m$^2$ with a coating color which contains a pigment and a binder, the pigment containing synthetic silica having a BET specific surface area ranging from 250 to 500 g/m$^2$ at a content of not less than 80 percent by weight of the pigment, the binder containing casein and styrene-butadiene rubber, the weight ratio of the pigment to the binder ranging from 1.8 to 2.4, the recording layer having coating solid in an amount ranging from 15 to 25 g/m$^2$, and surface roughness by ten-point-height of the recording layer ranging from 0.5 to 5 $\mu$m, and the paper sheet being curled at a maximum curling height ranging from 0 to 20 millimeters in A4 paper size with the printed face upside.

There are disclosed in U.S. Pat. No. 5,569,529 ink jet printing materials comprised of a support and an ink receiving layer containing a pigment, a hydrophilic binder comprising polyvinyl alcohol, vinylpyrrolidone homopolymer and/or vinyl pyrrolidone copolymer, and a water soluble compound containing aldehyde groups.

While known photographic papers are suitable for their intended purposes, a need remains for improved photographic papers with improved waterfastness and lightfastness. There is also a need for coated photographic papers with improved traction that avoid, or minimize the problems associated with the feeding of papers into various printers and copiers. Additionally, there is a need for photographic papers for ink jet printing with enhanced optical density, minimum showthrough, and less intercolor bleed. Further, there is a need for photographic papers for electrostatic printing processes, such as electrophotography, which exhibit excellent toner fix of the image to the photographic paper. Additionally, there is a need for photographic papers suitable for both ink jet printing processes and electrostatic printing processes which exhibit reduced curl and high optical density when used for ink jet printing, and which exhibit reduced curl and excellent toner fix when used for electrostatic printing. These and other needs are achievable in embodiments of the present invention.

SUMMARY OF THE INVENTION

It is an object of the present invention to provide photographic papers with many of the advantages illustrated herein.

It is another object of the present invention to provide improved photographic papers suitable for use in both ink jet printing processes and electrostatic printing processes.

It is another object of the present invention to provide photographic papers with improved traction when they are fed in various printers and copiers, especially xerographic printers and copiers, and, it is believed, digital systems.

It is yet another object of the present invention to provide improved coated photographic papers with reduced intercolor bleed between various colors.

It is still another object of the present invention to provide photographic papers for ink jet printing wherein the resulting images exhibit reduced curl and a high degree of light and waterfastness.

Another object of the present invention is to provide photographic papers for ink jet printing with enhanced optical density.

Still another object of the present invention is to provide photographic papers for electrostatic printing processes, such as electrophotography, which exhibit excellent toner fix of the image to the photographic paper.

It is another object of the present invention to provide photographic papers suitable for both ink jet printing processes and electrostatic printing processes which exhibit images with high gloss, high optical density, improved lightfastness and waterfastness when used for ink jet printing, and which exhibit reduced curl, excellent toner fix, high gloss and minimum scratching and scuffing of the images when used for electrostatic printing.

In embodiments, the present invention relates to ink jet papers comprised of (1) a substrate, such as paper, and preferably photographic paper, and the like, (2) a first ink receiving layer coating on one side, preferably the front side of the paper, especially photographic paper, and which coating is capable of absorbing the ink vehicle, and which coating is comprised of a hydrophilic polymer, such as polyvinylalcohol, an ink wetting/ink spreading agent, such as a poly(alkylene oxide), a flavor imparting compound, such as passion fruit flavor compounds like 3-methylthio-1-hexanol, a dye mordant, such as a quaternary compound, a lightfastness agent, such as 1,2-hydroxy-4-(octyloxy) benzophenone, 2-(4-benzoyl-3-hydroxyphenoxy)ethyl acrylate and the like, an optional biocide, such as 2-hydroxypropylmethane thiosulfonate, a filler, such as clay, calcium carbonate, colloidal silica, and (3) a second traction promoting coating in contact with the reverse side, or back side of the paper, especially photographic paper, and which coating is comprised of at least one, for example one to about 5, components and is selected from polymers having a glass transition temperature of between −50° C. to about 50° C., preferably from about −40° C. to about +25° C., such as polyester latex, a styrene-butadiene latex and the like, a filler, such as zirconium oxide, microspheres, such as glass spheres, an antistatic agent, a filler or pigment, a biocide, and the like. Embodiments of the present invention relate to a coated ink jet paper comprised of (1) a cellulosic substrate; (2) a first ink receiving layer coating on the front, or first side of the substrate capable of absorbing an ink vehicle, and which receiving layer coating is comprised of (a) a hydrophilic binder polymer, (b) an ink spreading agent, (c) a flavor imparting compound, (d) a dye mordant, (e) a lightfastness agent, (f) a filler, and (g) a biocide; and (3) a second traction controlling layer coating in contact with the reverse side, or backside of the substrate and which coating is comprised of (a) a polymer with a glass transition temperature of from about a −50° C. to about 50° C., (b) an antistatic agent, (c) a lightfastness agent, which agent can be comprised of a mixture of a UV absorbing compound, an antioxidant, and an antiozonant, (d) a filler, and (e) a biocide.

Disclosed are waterfast, lightfast photofinishing papers with a porous base paper with, for example, a porosity of from about 50 to about 200 milliliters/minute, and which bases include Lustro gloss papers, and which papers are, for example, from about 90 to about 175 microns in thickness, and coated on one side with a matte composition as indicated herein and with a hydrophilic binder, a dye mordant, and the like, and coated on the second, or opposite side of the first coating, a second coating or layer as indicated herein.

DETAILED DESCRIPTION OF THE INVENTION

The photographic papers of the present invention comprise a substrate or base sheet having a coating on both lateral surfaces thereof. Any suitable substrate can be employed, such as sized blends of hardwood kraft and softwood kraft fibers, which blends contain from about 10 percent to 90 percent by weight of softwood and from about 90 to about 10 percent by weight of hardwood. Examples of hardwood include Seagull W dry bleached hardwood kraft preferably present, for example, in one embodiment in an amount of 70 percent by weight. Examples of softwood include La Tuque dry bleached softwood kraft present, for example, in one embodiment in an amount of 30 percent by weight. These sized substrates may also contain pigments and pigments in effective amounts of from about 1 to about 60 percent by weight, such as clay (available from Georgia Kaolin Company, Astro-fil 90 clay, Engelhard Ansilex clay), titanium dioxide (available from Tioxide Company as Anatase grade AHR), calcium silicate CH-427-97-8, XP-974 (J. M. Huber Corporation), and the like. Also, the sized substrates may contain various effective amounts of sizing chemicals (for example from about 0.25 percent to about 25 percent by weight of pulp), such as Mon size (available from Monsanto Company), Hercon-76 (available from Hercules Company), Alum (available from Allied Chemicals as Iron free alum), and retention aid (available from Allied Colloids as Percol 292). The sizing values of papers, including the commercial papers that can be selected for the present invention in an embodiment thereof, vary between about 0.4 second to about 4,685 seconds, however, papers in the sizing range of 50 seconds to 300 seconds are preferred, primarily to decrease costs. The porosity values of the substrates, which are preferably porous, vary from about 100 to about 1,260 mil/minute and preferably from about 100 to about 600 mil/minute to permit, for example, the use of these papers for various printing technologies such as thermal transfer, liquid toner development, xerography, ink jet processes, and the like.

Illustrative examples of commercially available, internally and externally (surface) sized substrates that may be selected for the present invention and are treated with a desizing agent dispersed in an optional binder, and which substrates are of thickness of, for example, from about 50 microns to about 200 microns and preferably of a thickness of from about 100 microns to about 125 microns that may be selected for the aforementioned papers include Diazo papers, offset papers such as Great Lakes offset, recycled papers such as Conservatree, office papers such as Automimeo, Eddy liquid toner paper and copy papers from companies, such as Nekoosa, Champion, Wiggins Teape, Kymmene, Modo, Domtar, Veitsiluoto and Sanyo, with Xerox 4024™ papers and sized calcium silicate-clay filled papers being particularly preferred in view of their availability, and low print through.

The first layer coating composition capable of receiving images, especially images from an ink jet printer, is present on the front, or first side of the substrate of the coated photographic paper in any effective thickness. Typically, the total thickness of the coating layer is from about 0.1 to about 25 microns and preferably from about 0.5 to about 10 microns, although the thickness can be outside of these ranges. In the first coating composition, the binder can be present within the coating in any effective suitable amount.

In a total of 100 parts by weight, the first ingredient, such as the binder, is present in amounts of from about 5 parts by weight to about 70 parts by weight. When a mixture of two binders is used in the coating composition, one of the binders can be present in amounts of from about 3 parts by weight to about 40 parts by weight while the second binder can be present from about 2 parts by weight to about 30 parts by weight.

The second ingredient, or component of the coating composition is the ink wetting agent, such as poly(alkylene oxide), homologs like polyethylene oxide, and copolymers thereof like ethylene oxide/propylene oxide copolymers, and which agent is, for example, present in the first layer coating composition in amounts of from about 25 parts by weight to about 1 part by weight.

The third ingredient/component of the coating composition is the flavor imparting compounds and mixtures thereof, and this compound is present in the first coating composition in amounts of, for example, from about 20 parts by weight to about 1 part by weight. When a mixture of two flavor imparting compounds are selected in the coating composition, one of the flavor imparting compounds can be present in amounts of from about 15 parts by weight to about 0.5 part by weight, and the second flavor imparting compound can be present from about 5 parts by weight to about 0.5 parts by weight. When a mixture of three flavor imparting compounds is selected for the coating composition, one of the flavor imparting compounds can be present in amounts of from about 10 parts by weight to about 0.5 part by weight, and each of the and third second flavor imparting compounds can be present in amounts of from about 5 parts by weight to about 0.25 part by weight. When a mixture of four flavor imparting compounds is selected in the coating composition, each of the flavor imparting compounds can be present in amounts of from about 5 parts by weight to about 0.25 part by weight.

The fourth component of the coating composition is the dye, especially a cationic dye mordant or mixtures thereof, which are present in the first coating composition in amounts of from about 33 parts by weight to about 1 part by weight. When a mixture of two cationic dye mordants is used in the coating composition, one of the cationic dye mordants can be present in amounts of from about 23 parts by weight to about 0.5 part by weight, and the second cationic dye mordant can be present from about 10 parts by weight to about 0.5 part by weight.

The fifth component of the coating composition is the lightfastness compounds or mixtures thereof, and this component is present in the first coating composition in amounts of from about 12 parts by weight to about 1 part by weight. When a mixture of lightfastness compounds, which includes a UV absorbing compound and an antioxidant compound, the UV compound is present in amounts of, for example, from about 8 parts by weight to about 0.5 part by weight, and the antioxidant compound is present, for example, in amounts of from about 4 parts by weight to about 0.5 part by weight. When a mixture of lightfastness compounds includes a UV absorbing compound, an antioxidant compound and an antiozonant compound, the UV compound is present in, for example, amounts of from about 6 parts by weight to about 0.5 part by weight, the antioxidant compound is present, for example, in amounts of from about 3 parts by weight to about 0.25 part by weight, and the antiozonant compound is present, for example, in amounts of from about 3 parts by weight to about 0.25 part by weight.

The sixth component of the coating composition is the fillers, or pigments, and these fillers of the first layer coating composition are present in amounts of from about 1 part by weight to about 25 parts by weight.

The seventh component of the coating composition is the biocide of the first layer coating composition, and they are present in amounts of from about 4 parts by weight to about 1 part by weight.

Based on 100 parts, the first layer coating composition comprised of seven components such as (1) a binder, (2) ink wetting agent, (3) flavor imparting compounds, (4) cationic dye mordants, (5) lightfastness agents, (6) fillers, and (7) biocides has, for example, the following composition range (5+25+20+33+12+1+4=100) to (70+1+1+1+1+25+1=100).

In embodiments in the first layer coating composition of the coated photographic paper, the binder is present in amounts of from about 16 parts by weight to about 70 parts by weight, the ink spreading agent is present in an amount of from about 20 parts by weight to about 2 parts by weight, the flavor imparting compound is present in an amount of from about 20 parts by weight to about 2 parts by weight, the dye mordant is present in an amount of from about 30 parts by weight to about 3 parts by weight, the lightfastness inducing agents are present in amounts of from about 10 parts by weight to about 2 parts by weight, the filler is present in amounts of from about 1 part by weight to about 20 parts by weight, and the biocide compound is present in amounts of from about 3 parts by weight to about 1 part by weight. Thus, for example, based on 100 parts, the first layer coating composition is comprised of (1) a binder, (2) ink wetting agent, (3) flavor imparting compounds, (4) cationic dye mordants, (5) lightfastness agents, (6) fillers, (7) biocides, and has the following preferred composition range about (16+20+20+30+10+1+3=100) to about (70+2+2+3+2+20+1=100).

The aforementioned amounts can be determined, for example, as follows:

Various blends of the binder, the ink spreading agent, dye mordants, lightfastness inducing agent, fillers, and the biocide were prepared in water and coated on to various base sheets, such as paper, TESLIN® and opaque MYLAR®, to yield coated photographic papers with a single layer thereover and thereunder. After drying the base sheets at 100° C., they were tested for coating adhesion to the base sheet, printed with a Xerox Corporation ink jet test fixture to, for example, check print quality, drying times of the images, lightfastness and intercolor bleed. The data is then analyzed statistically for optimum range of compositions.

The binder polymers of the first layer coating composition which are present, for example, in amounts of from about 5 parts by weight to about 70 parts by weight and preferably from about 16 parts by weight to about 70 parts by weight include (a) hydrophilic polysaccharides and modifications thereof, such as (1) starch (such as starch SLS-280 available from St. Lawrence starch), (2) cationic starch (such as Cato-72, available from National Starch), (3) hydroxyalkyl starch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like (such as hydroxypropyl starch (#02382 available from Poly Sciences Inc.) and hydroxyethyl starch (#06733 available from Poly Sciences Inc.), (4) gelatin (such as Calfskin gelatin #00639 available from Poly Sciences Inc.), (5) alkyl celluloses and aryl celluloses, wherein alkyl has at least one carbon atom and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like, such as methyl cellulose (Methocel AM 4 available from Dow Chemical Company), and wherein aryl has at least 6 carbon atoms, for example from 6 to about 24 carbon atoms, such as preferably phenyl, and wherein the number of carbon atoms is such that the material is water soluble, (6) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like, such as hydroxyethyl cellulose (Natrosol 250 LR available from Hercules Chemical Company), and hydroxypropyl cellulose (Klucel Type E available from Hercules Chemical Company), (7) alkyl hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like, such as ethyl hydroxyethyl cellulose (Bermocoll available from Berol Kem. A. B. Sweden), (8) hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as hydroxyethyl methyl cellulose (HEM available from British Celanese Ltd., also available as Tylose MH, MHK from Kalle A. G.), hydroxypropyl methyl cellulose (Methocel K35LV available from Dow Chemical Company), and hydroxy butylmethyl cellulose (such as HBMC available from Dow Chemical Company), (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dihydroxypropyl cellulose, which can be prepared by the reaction of 3-chloro-1,2-propane with alkali cellulose), (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxypropyl hydroxyethyl cellulose available from Aqualon Company), (11) halodeoxycellulose, wherein halo represents a halogen atom (such as chlorodeoxycellulose, which can be prepared by the reaction of cellulose with sulfuryl chloride in pyridine at 25° C.), (12) amino deoxycellulose (which can be prepared by the reaction of chlorodeoxy cellulose with 19 percent alcoholic solution of ammonia for 6 hours at 160° C.), (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as diethylammonium chloride hydroxy ethyl cellulose, available as Celquat H-100, L-200, National Starch and Chemical Company), (14) hydroxyalkyl trialkyl ammonium halide hydroxyalkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as hydroxypropyl trimethyl ammonium chloride hydroxyethyl cellulose, available from Union Carbide Company as Polymer JR), (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, (such as diethyl amino ethyl cellulose, available from Poly Sciences Inc. as DEAE cellulose #05178), (16) carboxyalkyl dextrans, wherein alkyl has at least one carbon atom and wherein the number of carbon atoms is such that the material is water soluble, preferably from 1 to about 20 carbon atoms, more preferably, from 1 to about 10 carbon atoms, such as methyl, ethyl, propyl, butyl, pentyl, hexyl, and the like, (such as carboxymethyl dextrans available from Poly Sciences Inc. as #16058), (17) dialkyl aminoalkyl dextran, wherein each alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like (such as diethyl aminoethyl dextran, available from Poly Sciences Inc. as #5178), (18) amino dextran (available from Molecular Probes Inc), (19) carboxy alkyl cellulose salts, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethyl cellulose CMC 7HOF available from Hercules Chemical Company), (20) gum arabic (such as #G9752 available from Sigma Chemical Company), (21) carrageenan (such as #C1013 available from Sigma Chemical Company), (22) Karaya gum (such as #G0503, available from Sigma Chemical Company), (23) xanthan (such as Keltrol-T available from Kelco division of Merck and Company), (24) chitosan (such as #C3646 available from Sigma Chemical Company), (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as carboxymethyl hydroxypropyl guar available from Auqualon Company), (26) cationic guar (such as Celanese Jaguars C-14-S, C-15, C-17, available from Celanese Chemical Company), (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin, (28) dialkyl ammonium hydrolyzed collagen protein, wherein alkyl has at least one carbon atom and wherein the number of carbon atoms is such that the component is water soluble, preferably from 1 to about 20 carbon atoms, more preferably from 1 to about 10 carbon atoms, such as methyl, ethyl, propyl, butyl and the like (such as dimethyl ammonium hydrolyzed collagen protein available from Croda as Croquats), (29) agar-agar (such as that available from Pfaltz and Bauer Inc), (30) cellulose sulfate salts, wherein the cation is any conventional cation, such as sodium, lithium, potassium, calcium, magnesium, or the like (such as sodium cellulose sulfate #023 available from Scientific Polymer Products), and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethylhydroxyethyl cellulose CMHEC 43H and 37L available from Hercules Chemical Company);

(b) vinyl polymers, such as (1) poly(vinyl alcohol) (such as Elvanol available from Dupont Chemical Company), (2) poly(vinyl phosphate) (such as #4391 available from Poly Sciences Inc.), (3) poly(vinyl pyrrolidone) (such as those PVP K-15, PVP K-30, PVP K-60, PVP K-90, IGUAFEN A, PLASDONE K-25, PLASDONE K-26/28, PLASDONE K-29/32, PLASDONE C-15, PLASDONE C-30, PLASDONE XL, available from GAF Corporation), (4) vinyl pyrrolidone-vinyl acetate copolymers (such as #02587 available from Poly Sciences Inc.), (5) vinyl pyrrolidone-styrene copolymers (such as #371 available from Scientific Polymer Products), (6) poly(vinylamine) (such as #1562 available from Poly Sciences Inc.), (7) poly(vinyl alcohol) alkoxylated, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly(vinyl alcohol) ethoxylated #6573 available from Poly Sciences Inc.), and (8) poly(vinyl pyrrolidone-dialkylaminoalkyl alkylacrylate), wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly(vinyl pyrrolidone-diethylaminomethylmethacrylate) #16294 and #16295, available from Poly Sciences Inc.), (9) vinyl alcohol-vinyl acetate copolymer (such as #379 available from Scientific Polymer Products), and (10) vinyl alcohol-vinyl butyral copolymer (such as #381 available from Scientific Polymer Products);

(c) formaldehyde resins, such as (1) melamine-formaldehyde resin (such as BC 309 available from British Industrial Photographics Limited), (2) urea-formaldehyde resin (such as BC777 available from British Industrial Photographics Limited), and (3) alkylated urea-formaldehyde resins, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methylated urea-formaldehyde resins available from American Cyanamid Company as Beetle 65);

(d) ionic polymers, such as (1) poly(2-acrylamide-2-methyl propane sulfonic acid) (such as #175 available from Scientific Polymer Products), (2) poly(N,N-dimethyl-3,5-dimethylene piperidinium chloride) (such as #401 available from Scientific Polymer Products), and (3) poly(methylene-guanidine) hydrochloride (such as #654 available from Scientific Polymer Products);

(e) latex polymers, such as rubber latex such as neoprene available from Serva Biochemicals, acrylic emulsion latex, such as Rhoplex B-15J, Rhoplex P-376, from Rohm and Haas Company, Synthetic Rubber Latex 68-302 from Reichhold Chemicals Inc., biodegradable polyester resins such as polyglycolide, available as Dexon from American Cyanamid Company, polyesters of lactic acid such as polyglactin 910, Vicryl XLG, both being available from Ethicon Company; water soluble polyesters such as titanium derivatives of polyesters such as Tyzor available from E. I. DuPont de Nemours and Company;

(f) maleic anhydride and maleic acid containing polymers, such as (1) styrene-maleic anhydride copolymers (such as that available as Scripset from Monsanto, and the SMA series available from Arco), (2) vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinyl methyl ether-maleic anhydride copolymer #173 available from Scientific Polymer Products), (3) alkylene-maleic anhydride copolymers, wherein alkylene has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as ethylene-maleic anhydride copolymer #2308 available from Poly Sciences Inc., also available as EMA from Monsanto Chemical Company), (4) butadiene-maleic acid copolymers (such as #07787 available from Poly Sciences Inc.), (5) vinylalkylether-maleic acid copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinylmethylether-maleic acid copolymer available from GAF Corporation as Gantrez S-95), and (6) alkyl vinyl ether-maleic acid esters, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methyl vinyl ether-maleic acid ester #773 available from Scientific Polymer Products);

(g) acrylamide containing polymers, such as (1) poly (acrylamide) (such as #02806 available from Poly Sciences Inc.), (2) acrylamide-acrylic acid copolymers (such as #04652, #02220, and #18545, available from Poly Sciences Inc.), (3) poly(acrylamide-co-diallyidimethylammonium chloride), #40,908-1, from Aldrich Chemical Company; and (3) poly(N,N-dimethyl acrylamide) (such as #004590 available from Poly Sciences Inc.); and (h) poly(alkylene imine) containing polymers, wherein alkylene has two (ethylene), three (propylene), or four (butylene) carbon atoms, such as (1) poly(ethylene imine) (such as #135 available from Scientific Polymer Products), (2) poly(ethylene imine) epichlorohydrin (such as #634 available from Scientific Polymer Products), and (3) alkoxylated poly(ethylene imine), wherein alkyl has one (methoxylated), two (ethoxylated), three (propoxylated), or four (butoxylated) carbon atoms (such as ethoxylated poly (ethylene imine #636 available from Scientific Polymer Products); and the like, as well as blends or mixtures of any of the above. Any of the above ingredients in any relative amounts can be employed. When a mixture of two binders is used in the coating composition one of the binders can be present in amounts of from about 3 parts by weight to about 40 parts by weight while the second binder can be present in an amount of from about 2 parts by weight to about 30 parts by weight.

The ink wetting materials of the first layer, especially for ink jet applications, are present in amounts of, for example, from about 25 parts by weight to about 1 part by weight and preferably from about 20 parts by weight to about 2 parts by weight.

Examples of the Ink wetting/ink spreading materials or components include oxyalkylene-containing polymers, such as poly(oxy methylene), such as #009 available from Scientific Polymer Products, poly(oxyethylene) or poly (ethylene oxide), such as POLY OX WSRN-3000 available from Union Carbide Corporation, ethylene oxide/propylene oxide copolymers, such as ethylene oxide/propylene oxide/ethylene oxide triblock copolymer, such as Alkatronic EGE-31-1 available from Alkaril Chemicals, propylene oxide/ethylene oxide/propylene oxide triblock copolymers, such as Alkatronic PGP 3B-1 available from Alkaril Chemicals, tetrafunctional block copolymers derived from the sequential addition of ethylene oxide and propylene oxide to ethylene diamine, the content of ethylene oxide in these block copolymers being from about 5 to about 95 percent by weight, such as Tetronic 50R8 available from BASF Corporation, ethylene oxide/2-hydroxyl ethylmethacrylate/ethylene oxide and ethylene oxide/hydroxypropyl methacrylate/ethylene oxide triblock copolymers, which can be synthesized via free radical polymerization of hydroxyethyl methacrylate or hydroxypropyl methacrylate with 2-minoethanethiol using α, 'azobis isobutyronitrile as initiator and reacting the resulting amino-semitelechelic oligohydroxyethyl methacrylate or amino-hydroxypropyl methacrylate with an isocyanate-polyethylene oxide complex in chlorobenzene at 0° C., and precipitating the reaction mixture in diethylether, filtering and drying in vacuum, ethylene oxide/4-vinyl pyridine/ethylene oxide triblock copolymers, which can be synthesized via anionic polymerization of 4-vinyl pyridine with sodium naphthalene as initiator at −78° C. and then adding ethylene oxide monomer, the reaction being accomplished in an explosion proof stainless steel reactor, ionene/ethylene oxide/ionene triblock copolymers, which can be synthesized via quaternization reaction of one end of each 3—3 ionene with the halogenated (preferably brominated) poly(oxyethylene) in methanol at about 40° C., ethylene oxide/isoprene/ethylene oxide triblock copolymers, which can be synthesized via anionic polymerization of isoprene with sodium naphthalene in tetrahydrofuran as solvent at −78° C. and then adding monomer ethylene oxide and polymerizing the reaction for three days, after which time the reaction is quenched with methanol, the ethylene oxide content in the aforementioned triblock copolymers being from about 20 to about 70 percent by weight and preferably about 50 percent by weight, and the like, epichlorohydrin-ethyleneoxide copolymer such as #155 available from Scientific Polymer Products, as well as mixtures thereof.

The ink wetting agents of the first layer that are derived from alcohols include: trimethylolpropane (Aldrich #23,974-7), trimethylolpropane ethoxylate (Aldrich #40,977-4; Aldrich #40,978-2; Aldrich #41,616-9; Aldrich #41,617-7), trimethylolpropane triacrylate (Aldrich #24,680-8), trimethylolpropane trimethcrylate (Aldrich #24,684-0), trimethylolpropane ethoxylate triacrylate (Aldrich #41,217-1; #41,219-8), trimethylolpropane propoxylate triacrylate (Aldrich #40,756-9; #40,757-7), trimethylolpropane ethoxylate methylether diacrylate (Aldrich #40,587-1), trimethylolpropane tris(2-methyl-1-aziridine propionate) (Aldrich #40,544-2), neopentyl glycol ethoxylate (Aldrich #41,027-6), neopentyl glycol propoxylate (Aldrich #40,987-1; Aldrich #41,214-7), glycerol propoxylate (Aldrich #37,389-3; Aldrich #37,390-7; Aldrich #37,391-5; Aldrich #37,392-3; Aldrich #37,396-6; Aldrich #41,028-4), glycerol propoxylate-b-ethoxylate triol (Aldrich #37,386-9; Aldrich #37,387-7; Aldrich #37,388-5), glycerol ethoxylate-b-propoxylate triol (Aldrich #40,918-9), pentaerythritol ethoxylate (Aldrich #41,615-0; 41,873-0), pentaerythritol propoxylate (Aldrich #41,874-9; 41,875-7), pentaerythritol propoxylate/ethoxylate (Aldrich #42,502-8), triethanol amine ethoxylate (Aldrich #41,658-4), N-methyl diethanolamine (Aldrich #M4,220-3), N-ethyl diethanolamine (Aldrich #11,206-2), N-butyl diethanolamine (Aldrich #12,425-7), N-phenyl diethanolamine (Aldrich #P2,240-0), triethanol amine (Aldrich #T5,830-0), trioctylamine (Aldrich #T8,100-0), 4-xylylene diamine (Aldrich #27,963-3), 1,4-bis(2-hydroxyethoxy)-2-butyne (Aldrich #B4,470-8), pantothenol (Aldrich #29,578-7), 1-phenyl-1,2-ethanediol (Aldrich #30,215-5; #P2,405-5), 3-ethoxy-1,2-propanediol (Aldrich #26,040-1), 3-allyloxy-1,2-propanediol (Aldrich #25,173-9), 3-ethoxy-1,2-propanediol (Aldrich #26,042-8), 3-phenoxy-1,2-propanediol (Aldrich #25,781-8), 3-octadecyloxy-1,2-propanediol (Aldrich #B40-2), 3-(4-methoxy phenoxy)-1,2-propanediol (Aldrich #21,024-2), Mephensin [3-(2-methyl phenoxy)-1,2-propanediol] (Aldrich #28,656-7), 3-diethylamino)-1,2-propanediol (Aldrich #21,849-9), 2-phenyl-1,2-propanediol (Aldrich #21,376-4), 3-amino-1,2-propanediol (Aldrich #A7,600-1), 3-(diisopropyl amino)-1,2-propanediol (Aldrich #25,766-4), 3-(N-benzyl-N-methylamino)-1,2-propanediol (Aldrich #21,850-2), 3-pyrrolidino-1,2-propanediol (Aldrich #21,851-0), 3-piperidino-1,2-propanediol (Aldrich #21,849-9), 3-morpholino-1,2-propanediol (Aldrich #21,848-0), 2.2-dimethyl-1-phenyl-1,3-propanediol (Aldrich #40,873-5), 2-benzyloxy-1,3-propanediol (Aldrich #36,744-3), 4-8-bis (hydroxymethyl) tricyclo[5.2.1.02.6]decane (Aldrich #B4,590-9), 1-[N,N-bis(2-hydroxyethyl)isopropanolamine (Aldrich #23,375-7), N,N-bis(2-hydroxypropyl) ethanolamine (Karl-Industries), 1-[2-(2-hydroxyethoxy) ethyl]-piperazine (Aldrich #33,126-0), 1-4-bis(2-hydroxy ethyl)piperazine (Aldrich #B4,540-2), homovanillyl alcohol (Aldrich #14,883-0), phenethyl alcohol (Aldrich #P1,360-6), 3,6-dimethyl-4-octyne-3,6-diol (Aldrich 27,840-8), 2-(hydroxymethyl)-1,3-propanediol (Aldrich #39,365-7), 2-butyl-2-ethyl-1,3-propanediol (Aldrich #14,247-6), 2-piperidine methanol (Aldrich #15,522-5), 2,2,4-trimethyl-1,3-pentanediol (Aldrich #32,722-0), Vitamin E (Aldrich

#25,802-4), Vitamin E acetate (Aldrich #24,817-7), Vitamin K (Aldrich #28,740-7), tri(ethylene glycol)dimethylacrylate (Aldrich #26,154-8), triethyl citrate (Aldrich #10,929-0), 2,4,7,9-tetramethyl-5-decyne-4,7-diol (Aldrich #27,838-6); and mixtures thereof.

The ink wetting agents of the first layer that are derived from surfactants include, for example, (1) hydrophilic poly (dimethyl siloxanes) such as (a) poly(dimethyl siloxane) monocarbinol terminated (PS558, Petrarch Systems Inc.) and dicarbinol terminated (PS555, PS556, Petrarch Systems Inc.); (b) poly(dimethyl siloxane)-b-poly(methyl siloxane alkylene oxide) copolymers (PS073, PS072, PS071, Petrarch Systems Inc.), Alkasil HEP 182-280, Alkasil HEP 148-330, Alkaril Chemicals, non-hydrolyzable copolymers containing S1-C linkages; (c) poly(dimethylsiloxane)-b-poly(propyleneoxide)-b-poly(ethylene oxide) copolymers (Alkasil NEP 73-70, Alkaril Chemicals), hydrolyzable copolymer containing S1-O-C linkages; (d) polyquaternary poly(dimethyl siloxane) copolymers (which can be obtained by the addition reaction of α, (-hydrogen polysiloxane with epoxides containing olefinic bonds and then reacting the product with a diamine); (2) poly(alkylene glycol) and its derivatives (a) poly(propylene glycol) (Alkapol PPG-425, Alkapol PPG-4000, Alkaril Chemicals); (b) poly(propylene glycol dimeth acrylate), poly(ethylene glycol diacrylate), poly(ethylene glycol dimethacrylate), poly(ethylene glycol monomethyl ether), poly(ethylene glycol dimethyl ether), poly(ethylene glycol diglycidyl ether) (all from Polysciences); (c) poly(1,4-oxybutylene glycol) (Scientific Polymer Products); (3) copolymers of liophilic poly (propylene oxide) with hydrophilic poly(ethylene oxide); (a) methanol soluble-Tetronic 150R1, Pluronic L-101, Tetronic 902, Tetronic 25R2 (BASF Corporation), Alkatronic EGE-1 (Alkaril Chemicals); (b) water soluble-Tetronic 908, 50R8, 25R8, 904, 90R4, Pluronic F-77, all from BASF Corporation, and Alkatronic EGE 25-2 and PGP 33-8 from Alkaril Chemicals; (4) fatty ester modifications of (a) phosphates (Alkaphos B6-56A, Alkaril Chemicals); (b) sorbitan (Alkamuls STO [sorbitan trioleate], Alkamuls SML [sorbitan mono laurate], Alkamuls SMO [sorbitan monooleate], Alkaril Chemicals); (c) glycerols (Alkamuls GMO-45LG [glyceryl mono oleate], Alkamuls GDO [glyceryl dioleate], Alkamuls GTO [glyceryl trioleate]); (d) poly(ethylene glycols) (Alkamuls 600 DO [di oleate], Alkamuls 400-ML [mono laurate], Alkamuls 600 MO [mono oleate], Alkamuls 600 DL [dilaurate], Alkamuls 600 DT [ditallow], Alkaril Chemicals); (e) sulfosuccinic acid (Alkasurf SS-O-75 [sodium dioctyl sulfosuccinate], Alkasurf SS-DA4-HE [ethoxlated alcohol sulfosuccinate], Alkasurf SS-L7DE [sodium sulfosuccinate ester of lauric diethanol amide], Alkasurf SS-L-HE (sodium lauryl sulfosuccinate], Alkaril Chemicals); (f) sulfonic acid (Alkasurf CA, [calcium dodecyl benzene sulfonate], Alkasurf 1 PAM [isopropylamine dodecyl benzene sulfonate], Alkaril Chemicals); (g) alkyl amines (Alkamide SDO [soya diethanol amide], Alkamide CDE [coco diethanol amide], Alkamide CME [coco monoethanol amide], Alkamide L9DE [lauric diethanol amide], Alkamide L7Me [lauric monoethanol amide], Alkamide L1PA [lauric monoisopropylamide], Alkaril Chemicals); (5) poly (oxalkylene) modifications of (a) sorbitan esters (Alkamuls PSML-4 [poly(oxyethylene) sorbitan monolaurate], Alkamuls PSMO-20 [poly(oxyethylene) sorbitan monooleate], Alkamuls PSTO-20 [poly(oxyethylene) sorbitan trioleate], Alkaril Chemicals); (b) fatty amines (Alkaminox T-2,T-5 [tallow amine ethoxylate], Alkaminox SO-5 [soya amine ethoxylate], Alkaril Chemicals), (Icomeen T-2, Icomeen T-15, ICI Chemicals); (c) castor oil (Alkasurf CO-10 [caster oil ethoxylates], Alkaril Chemicals); (d) alkanol amide (Alkamide C-2, C-5 [coconut oil alkanolamide ethoxylates], Alkaril Chemicals); (e) fatty acid (Alkasurf 075-9, Alkasurf 0-10 [oleic acid ethoxylates], Alkasurf L-14 [lauric acid ethoxylate], Alkasurf P-7 [palmitic acid ethoxylate]); (f) fatty alcohol (Alkasurf LAN-1, LAN-3 Alkasurf TDA-6, Alkasurf SA-2, [linear alcohol ethoxylates], Alkasurf NP-1, NP-11 [nonyl phenol ethoxylates], Alkasurf OPÛ1, OP-12 [octyl phenol ethoxylates], Alkasurf LAEP-15, Alkasurf LAEP-25, Alkasurf LAEP-65 [linear alcohol alkoxylates]); (6) quaternary compounds (a) nonpolymeric quaternary ammonium ethosulfate (Finquat, Conn., Cordex AT-172, Finetex Corporation); (b) quaternary dialkyl dimethyl methosulfate (Alkaquat DHTS [hydrogenated tallow]); (c) alkoxylated difatty methosulfate quaternary (Alkasurf DAET [tallow derivative]); (d) fatty imidazoline methosulfate quaternary (Alkaquat T [tallow derivatives], Alkaril Chemicals); (7) fatty imidazolines and their derivatives (a) Alkazine O [oleic derivative]; (b) Alkazine TO [tail oil derivatives]; (c) Alkateric 2CIB (dicarboxylic cocoimidazoline sodium salt), Alkaril Chemicals; (d) Arzoline-4, (e) Arzoline-215, Baker Chemicals; and the like.

Further, the ink receiving layers of the photographic papers of the present invention contains flavor imparting compounds in amounts of from about 20 parts by weight to about 1 part by weight and preferably from about 20 parts by weight to about 2 parts by weight including apple flavor compounds such as isoamyl acetate (Aldrich #30,696-7), ethyl-2-methylbutyrate (Aldrich #30,688-6), n-hexanal (Aldrich #11,560-6), rose flavor compounds such as damascenone (CAS #23,696-85-7; CAS #23,726-93-4); musk flavor compounds such as muscone (CAS #541-91-3); sandle wood flavor compounds such as eremophilone (CAS #562-23-2); anise flavor compounds such as anethole (Aldrich #11,787-0); blueberry flavor compounds such as isobutyl 2-buteneoate (CAS #589-66-2); caramel flavor compounds such as 2,5-dimethyl-4-hydroxy-3(2H)-furanone (Aldrich #32,248-2); caraway and spearmint flavor compounds such as carvone (Aldrich #12,493-1); cherry flavor compounds such as benzaldehyde (Aldrich #B,133-4), tolyl aldehyde (CAS #23696-85-7), benzyl acetate (Aldrich #B1,580-5); chocolate flavor compounds such as 5-methyl-2-phenyl-2-hexenal (CAS #21834-92-4), isoamyl butyrate (CAS #106-27-4), vanilin (Aldrich #V,110-4), isoamyl phenylacetate (CAS #102-19-2), 2-methoxy-5-methylpyrazine (Aldrich #29,794-1); cinnaman flavor compounds such as cinnamic aldehyde (Aldrich #23,996-8); coffee flavor compounds such as furfuryl mercaptan (Aldrich #F2,040-8), furfuryl thiopropionate (CAS #59020-85-8); coconut flavor compounds such as γ-nonalactone (CAS #104-61-0); cognac flavor compounds such as ethyl oenanthate (CAS #106-30-9); fresh fruit flavor compounds such as 2-methyl-2-pentenoic acid (Aldrich #26,477-6); grape and honey flavor compounds such as methyl anthranilate (Aldrich #23,645-4), ethyl 3-hydroxybutyrate (Aldrich #E3,060-3); grapefruit flavor compounds such as nootkatone (CAS #4674-50-4); hazlenut flavor compounds such as methyl (methylthio)pyrazine (CAS #21948-70-9); jasmine flavor compounds such as benzyl acetate (Aldrich #B1,580-5), indole (Aldrich #26,907-7); lime and lemon flavor compounds such as citral (Aldrich #C8,300-7), α-terpineol (Aldrich #21,837-5); mandarin, orange, tangerine flavor compounds such as β-sinensal (CAS #8028-48-6), dimethyl anthranilate (CAS #85-91-6), thymol (Aldrich #11,209-7), octyl aldehyde (Aldrich #O,560-8), decyl aldehyde (Aldrich #12,577-6); melon flavor compounds such as 2-methyl-3,4-tolylpropionaldehyde (CAS #16251-78-8), hydroxycitronellal dimethyl acetal (CAS #141-92-4),2,6-dimethyl-5-heptenal (CAS #106-72-9); 2-phenylpropionaldehyde (Aldrich #24,136-9), 2-methyl-3-(4-isopropylphenyl)propionaldehyde; maple flavor compounds such as 3-methyl-1,2-cyclopentanedione (Aldrich #17,850-0); peppermint and mint flavor compounds such as menthol (Aldrich #M,277-2); passion fruit flavor compounds such as 3-methylthio-1-hexanol (Aldrich #30,374-7); peach flavor compounds such as γ-undecalactone (Aldrich #U,80-6), 6-amyl-α-pyrone (CAS #27593-23-3); peanut flavor compounds such as 2,5-dimethyl pyrazine (Aldrich #17,542-0); pear flavor compounds such as ethyl decane-cis-4-trans-2-dienoate (CAS #3025-30-7); pineapple flavor compounds such as allyl caproate (CAS #123-68-2), methyl β-methylthiopropionate (Aldrich #10,337-3), allyl cyclohexane propionate (Aldrich #41,165-5); raspberry flavor compounds such as 6-methyl-α-ionone (CAS #79-69-6), trans-α-ionone (CAS #127-41-3), 4-(4-hydroxyphenyl)-2-butanone (Aldrich #17,851-9); strawberry flavor compounds such as ethyl maltol (CAS #4940-11-8), methyl cinnamate (Aldrich #17,328-2), 4-hydroxy-2,5-dimethyl-3(2H)-furanone (Aldrich #32,248-2), ethylmethyl phenyl glycidate (CAS #77-83-8); vanila flavor compounds such as ethyl vanilin (Aldrich #12,809-0), propenyl quaethol (CAS #94-86-0); and the like.

Also, the ink receiving layers of the photographic papers of the present invention contains lightfastness agents in amounts of from about 12 parts by weight to about 1 part by weight and preferably from about 10 parts by weight to about 2 parts by weight. The lightfastness agents are illustrated in copending application U.S. Ser. No. 656,814, the disclosure of which is totally incorporated herein by reference. The preferred lightfastness agents for the present application include UV absorbing compounds such as poly [N,N-bis(2,2,6,6-tetramethyl-4-piperidinyl)-1,6-hexanediamine-co-2,4-dichloro-6-morpholino-1,3,5-triazine), available as Cyasorb UV-3346, #41,324-0 from Aldrich Chemical Company, poly(4-hydroxy-2,2,6,6-tetramethyl-1-piperidine ethanol/dimethyl succinic acid), available as Tinuvin 622LD from Ciba-Geigy Corporation, poly(3,5-di-tert-butyl-4-hydroxy hydrocinnamic acid ester/1,3,5-tris(2-hydroxyethyl)-5-triazine-2,4,6(1H,3H,5H)-trione, available as Good-rite 3125 from Goodrich Chemicals, 2-hydroxy-4-(octyloxy)benzophenone, available as Cyasorb UV-531, #41,315-1, from Aldrich Chemical Company, 2-(4-benzoyl-3-hydroxy phenoxy)ethyl acrylate (Cyasorb UV-416, #41,321-6, available from Aldrich Chemical Company), and the like; lightfast antioxidant compounds such as didodecyl 3,3'-thiodipropionate, available as Cyanox, LTDP, #D12,840-6, from Aldrich Chemical Company; ditridecyl-3,3'-thiodipropionate, available as Cyanox 711, #41,311-9, from Aldrich Chemical Company; ditetradecyl-3,3'-thiodipropionate, available as Cyanox, MTDP, #41,312-7, from Aldrich Chemical Company; dicetyl-3,3'-thiodipropionate, available as Evanstab 16 from Evans Chemetics Corporation, antiozonant compounds such as N-(1,3-dimethylbutyl)-N'-phenyl-phenylene diamine, available as Santoflex 13 from Monsanto Chemicals, N,N'-di(2-octyl)-ρ-phenylene diamine, available as Antozite-1 from Vanderbilt Corporation, N,N'-bis(1,4-dimethyl pentyl)-ρ-phenylene diamine, available as Santoflex 77 from Monsanto Chemicals, and mixtures thereof.

The biocides of the ink receiving layers are present in amounts of, for example, from about 4 parts by weight to about 1 part by weight and preferably from about 3 parts by weight to about 1 part by weight. Examples of suitable biocides useful for the ink receiving layers of the papers of the present invention are described in copending application U.S. Ser. No. 196,605, the disclosure of which is totally incorporated herein by reference, and are present in, for example, amounts of from about 4 parts by weight to about 1 part by weight and preferably from about 3 parts by weight to about 1 part by weight. The preferred biocides for use in the present application include (A) nonionic biocides, such as (1) 2-hydroxypropylmethane thiosulfonate (Busan 1005 available from Buckman Laboratories Inc.), (2) 2-(thio cyanomethyl thio) benzothiazole (Busan 30WB, 72WB, available from Buckman Laboratories Inc.), (3) methylene bis(thiocyanate) (Metasol T-10 available from Calgon Corporation, AMA-110 available from Vinings Chemical Company, Vichem MBT available from Vineland Chemical Company, Aldrich 10,509-0), (B) anionic biocides, such as (1) anionic potassium N-hydroxymethyl-N-methyl-dithiocarbamate (available as BUSAN 40 from Buckman Larboratories Inc.), (2) an anionic blend of N-hydroxymethyl-N-methyl dithiocarbamate (80 percent by weight) and sodium 2-mercapto benzothiazole (20 percent by weight) (available as BUSAN 52 from Buckman Laboratories Inc.), (C) cationic biocides, such as (1) cationic poly(oxyethylene(dimethylamino)-ethylene (dimethylamino)ethylene dichloride) (Busan 77 available from Buckman Laboratories Inc.), (2) a cationic blend of methylene bisthiocyanate and dodecyl guanidine hydrochloride (available as SLIME TROL RX-31, RX-32, RX-32P, RX-33, from Betz Paper Chem Inc.).

In addition, the first ink jet receptive layer coating compositions of the present invention contain cationic dye mordants that can be present in any effective amount, and typically are present in amounts of from about 33 parts by weight to about 1 part by weight and preferably from about about 30 parts by weight to about 3 parts by weight. Examples of cationic dye mordants include quaternary salts, such as Cordex AT-172, and other materials available from Finetex Corporation, quaternary acrylic copolymer latexes; also suitable are monoammonium compounds as disclosed in, for example, U.S. Pat. No. 5,320,902, the disclosure of which is totally incorporated herein by reference, formaldehyde-free GARDOL DR/NF® available from Apollo Chemical Corporation, polyquaternary amine PERCHEM 553® available from Chem link industrial, polyquaternary amine POLY PLUS 1290® available from Betz Paper Chem Inc; ARMOSOFT 420-90® available from Akzo Chemie Chemicals, quaternary ammonium block copolymers, such as Mirapol A-15 and Mirapol WT available from Miranol, Incorporated, Dayton, N.J., prepared as disclosed in U.S. Pat. No. 4,157,388, the disclosure of which is totally incorporated herein by reference, Mirapol AZ-1 available from Miranol, Incorporated, prepared as disclosed in U.S. Pat. No. 4,719,282, the disclosure of which is totally incorporated herein by reference, Mirapol AD-1 available from Miranol, Incorporated, prepared as disclosed in U.S. Pat. No. 4,157,388, Mirapol 9, Mirapol 95, and Mirapol 175, available from Miranol, Incorporated, Dayton, N.J., prepared as disclosed in U.S. Pat. No. 4,719,282, as well as mixtures thereof. Also suitable are phosphonium compounds, such as, for example, those disclosed in copending application U.S. Ser. No. 08/034,917, the disclosure of which is totally incorporated herein by reference.

The ink receiving coating composition also contains particulate materials, that is fillers, present in amounts of from about 1 part by weight to about 25 parts by weight, and more specifically, from about 7 parts by weight to about 20 parts by weight. Examples of filler components are described in the copending application U.S. Ser. No. 656,814, the disclosure of which is totally incorporated herein by reference. The preferred fillers include hollow microspheres, such as Eccospheres MC-37 (sodium borosilicate glass), Eccospheres FTD 202 (high silica glass, 95 percent $S10_2$), and Eccospheres SI (high silica glass, 98 percent $S10_2$), all available from Emerson and Cuming Inc., zirconium oxide (SF-EXTRA available from Z-Tech Corporation), colloidal silicas, such as Syloid 74 available from Grace Company (preferably present, in one embodiment, in an amount of from about 10 to about 70 percent by weight percent), amorphous silica available as Flow-Gard CC 120, Flow-Gard CC 140, Flow-Gard CC 160, from PPG Industries, titanium dioxide (available as Rutile or Anatase from NL Chem Canada, Inc.), hydrated alumina (Hydrad TMC-HBF, Hydrad TM-HBC, available from J. M. Huber Corporation), barium sulfate (K. C. Blanc Fix HD80 available from Kali Chemie Corporation), calcium carbonate (Microwhite Sylacauga Calcium Products), high brightness clays (such as Engelhard Paper Clays), calcium silicate (available from J. M. Huber Corporation), cellulosic materials insoluble in water or any organic solvents (such as those available from Scientific Polymer Products), blends of calcium fluoride and silica, such as Opalex-C available from Kemira. O. Y, zinc oxide, such as Zoco Fax 183 available from Zo Chem, blends of zinc sulfide with barium sulfate, such as Lithopane available from Schteben Company, barium titanate, #20, 810-8 available from Aldrich Chemicals, antimony oxide #23,089-8 available from Aldrich Chemicals, as well as mixtures thereof. Brightener fluorescent pigments of coumarin derivatives, such as formula #633 available from Polymer Research Corporation of America, fluorescent pigments of oxazole derivatives, such as formula #733 available from Polymer Research Corporation of America, can enhance color mixing and assist in improving print-through in papers of the present invention.

The second layer coating composition in contact with the reverse side of the substrate is present on the substrate of the coated ink jet photographic papers of the present invention in any effective thickness. Typically, the total thickness of the second coating layer is from about 0.1 to about 25 microns and preferably from about 0.5 to 10 microns, although the thickness can be outside of these ranges. The second traction controlling composition on the reverse side of the substrate was derived using an experimental design similar to that used for the first layer composition. The difference between the first layer coating and the second layer coating is in their coefficient of friction, which is higher in the second coating due primarily to the increased amount of filler, or pigment. The binder is present in amounts of from about 70 parts by weight to about 7 parts by weight and preferably from 70 parts by weight to about 14 parts by weight, the antistatic agent is present in an amount of from about 20 parts by weight to about 1 parts by weight and preferably from about 20 parts by weight to about 3 parts by weight, the lightfastness agent is present in amounts of from about 6 parts by weight to about 1 parts by weight and preferably from about 6 parts by weight to about 2 parts by weight, the filler is present in amounts of from about 1 part by weight to about 90 parts by weight and preferably from about 1 part by weight to about 80 parts by weight, and the biocide compound is present in amounts of from about 3 parts by weight to about 1 part by weight. Based on 100 parts, the preferred composition range of the (1) binder, (2) antistatic agent, (3) lightfastness agent, (4) fillers, and (5) biocides in the second layer, the amounts are, for example, about (70+20+6+1+3) to about (14+3+2+80+1).

The binder polymers of the second layer are derived from those indicated herein for the first layer. Additional binders include latex polymers, such as polyester latex such as Eastman AQ 29D available from Eastman Chemical Company; cationic, anionic, and nonionic styrene-butadiene latexes (such as that available from Gen Corp Polymer Products, such as RES 4040 and RES 4100 available from Unocal Chemicals, and such as DL 6672A, DL6638A, and DL6663A, available from Dow Chemical Company), ethylene-vinylacetate latex (such as Airflex 400 available from Air Products and Chemicals Inc.), vinyl acetate-acrylic copolymer latexes (such as synthemul 97-726 available from Reichhold Chemical Inc, Resyn 25-1110 and Resyn 25-1140 available from National Starch Company, and RES 3103 available from Unocal Chemicals, as well as mixtures thereof.

Monoester sulfosuccinates, diester sulfosuccinates and sulfosuccinamates are anionic antistatic components which have been found suitable for use in the second coating in amounts of, for example, from about 20 parts by weight to about 3 parts by weight. Suitable cationic antistatic components comprise diamino alkanes; quaternary salts; quaternary acrylic copolymer latexes; ammonium quaternary salts as disclosed in U.S. Pat. No. 5,320,902; phosphonium quaternary salts as disclosed in copending application U.S. Ser. No. 08/034,917; and sulfonium, thiazolium and benzothiazolium quaternary salts as disclosed in U.S. Pat. No. 5,314,747.

The fillers/pigments, the lightfastness agents, and the biocides of the second layer are similar to or the same as those components for the first layer coating composition.

The coating compositions of the present invention can be applied to the substrate by any suitable technique. For example, the layer coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. The die can have one or more slots if multilayers are to be applied simultaneously. In the multilayer slot coating, the coating solutions form a liquid stack in the gap where the liquids come in the contact with the moving web to form a coating. The stability of the interface between the two layers depends on wet thickness, density and viscosity ratios of both layers which need to be kept as close to one as possible. Once the desired amount of coating has been applied to the web, the coating is dried, typically at from about 25 to about 150° C. in an air dryer.

The Hercules size values recited herein were measured on the Hercules sizing tester (available from Hercules Incorporated) as described in TAPPI STANDARD T-530 pm-83, issued by the Technical Association of the Pulp and Paper Industry. This method is closely related to the widely used ink flotation test. The TAPPI method has the advantage over the ink flotation test of detecting the end point photometrically. The TAPPI method employs a mildly acidic aqueous dye solution as the penetrating component to permit optical detection of the liquid front as it moves through the paper. The apparatus determines the time required for the reflectance of the sheet surface not in contact with the penetrant to drop to a predetermined (80 percent) percentage of its original reflectance.

The porosity values recited herein were measured with a Parker Print-Surf porosimeter, which records the volume of air per minute flowing through a sheet of paper. The edge raggedness values recited in the present application were measured using an Olympus microscope equipped with a camera capable of enlarging the recorded ink jet images. The edge raggedness value is the distance in millimeters for the intercolor bleed on a checkerboard pattern.

The coated ink jet photographic papers of the present invention exhibit reduced curl upon being printed with aqueous inks. Generally, "curl" refers to the distance between the base line of the arc formed by recording sheet when viewed in cross-section across its width (or shorter dimension, for example, 8.5 inches in an 8.5 by 11 inch sheet, as opposed to length, or longer dimension, for example, 11 inches in an 8.5 by 11 inch sheet) and the midpoint of the arc. To measure curl, a sheet can be held with the thumb and forefinger in the middle of one of the long edges of the sheet (for example, in the middle of one of the 11 inch edges in an 8.5 by 11 inch sheet) and the arc formed by the sheet can be matched against a pre-drawn standard template curve.

The lightfastness values of the ink jet images were measured in the Mark V Lightfastness Tester obtained from Microscal Company, London, England.

The gloss values recited herein were obtained on a 75° Gloss meter, Glossgard from Pacific Scientific (Gardner/Neotec Instrument Division). The edge raggedness values recited in the present application were measured using an Olympus microscope equipped with a camera capable of enlarging the recorded ink jet images. The edge raggedness value is the distance in millimeters for the intercolor bleed on a checkerboard pattern.

The optical density measurements recited herein were obtained on a Pacific Spectrograph Color System which consists of two major components, an optical sensor and a data terminal. The optical sensor employs a 6 inch integrating sphere to provide diffuse illumination and 2 degrees viewing. This sensor can be used to measure both transmission and reflectance samples. When reflectance samples are measured, a specular component may be included. A high resolution, full dispersion, grating monochromator was used to scan the spectrum from 380 to 720 nanometers (nm). The data terminal features a 12 inch CRT display, numerical keyboard for selection of operating parameters, and the entry of tristimulus values, and an alphanumeric keyboard for entry of product standard information. The print through value as characterized by the printing industry is Log base 10 (reflectance of a single sheet of unprinted paper against a black background/reflectance of the back side of a black printed area against a black background) measured at a wavelength of 560 nanometers.

Specific embodiments of the invention will now be described in detail. These Examples are intended to be illustrative, and the invention is not limited to the materials, conditions, or process parameters set forth in these embodiments. All parts and percentages are by weight unless otherwise indicated.

EXAMPLE I

Coated ink jet photographic papers were prepared by the solvent extrusion process (single side each time initially) on a Faustel Coater using a one slot die, by providing for each a paper base sheet (roll form) with a thickness of 100 microns with a Hercules size value of 400 seconds, a porosity of 100 mil/minute and coating the base sheets with a composition comprised of 30.0 parts by weight of the hydrophilic binder hydroxypropyl cellulose (Klucel Type E available from Hercules Chemical Company), 20.0 parts by weight of the ink wetting agent poly(ethylene oxide), POLY OX WSRN-3000 available from Union Carbide Corporation, 10.0 parts by weight of the flavor imparting peach flavor compound γ-undecalactone (Aldrich #U,80-6), 25.0 parts by weight of the dye mordant quaternary acrylic copolymer latex polymethyl acrylate trimethyl ammonium chloride latex, HX42-1 available from Interpolymer Corporation, 2.0 parts by weight of the UV absorber poly [N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich Chemical Company), 2.0 parts by weight of the antioxidant didodecyl-3,3'-thiodipropionate, 1.0 part by weight of the biocide 2-hydroxypropylmethane thiosulfonate (Busan 1005 available from Buckman Laboratories Inc.); 10.0 parts by weight of the filler colloidal silica, Syloid 74 available from W. R. Grace and Company, which filler composition was present in a concentration of 10 percent by weight in water subsequent to air drying at 100° C. (Centigrade) and monitoring the difference in weight prior to and subsequent to coating, the dried paper base sheet rolls contained 1.0 gram, 11 microns in thickness, of the ink receiving layer.

Rewinding the coated side of the paper base sheet (roll form) on to an empty core and using these rolls, the uncoated side of the paper base sheets were coated with a blend comprised of 30.0 parts by weight poly(vinyl alcohol) ethoxylated, #6573 available from Poly Sciences Inc., 15.0 parts by weight of the antistatic agent quaternary acrylic copolymer latex polymethyl acrylate trimethyl ammonium chloride latex, HX42-1 available from Interpolymer Corporation, 2.0 parts by weight of the UV absorbing agent poly[N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich Chemical Company), 2.0 parts by weight of the antioxidant didodecyl-3,3'-thiodipropionate, 1.0 part by weight of the biocide cationic poly(oxyethylene (dimethylamino)-ethylene(dimethylamino)ethylene dichloride) (Busan 77 available from Buckman Laboratories Inc.); and 50.0 parts by weight of colloidal silica, Syloid 74 available from W. R. Grace and present in a concentration of 10 percent by weight in water. Subsequent to air drying at 100° C. (Centigrade throughout) and monitoring the difference in weight prior to and subsequent to coating, the dried paper base sheet rolls contained 1.0 gram, 11 microns in thickness, of the traction controlling pigmented coating. The coated ink jet photographic papers were cut from this roll in 8.5 by 11.0 inch cut sheets.

Preparation of the Ink Jet Image on the Coated Ink Jet Photographic Papers

The coated ink jet photographic papers prepared were then incorporated into a Hewlett-Packard 500-C color ink jet printer containing inks of the following compositions:

Cyan: 15.785 percent by weight of sulfolane, 10.0 percent by weight of butyl carbitol, 2.0 percent by weight of ammonium bromide, 2.0 percent by weight of N-cyclohexylpyrollidinone obtained from Aldrich Chemical Company, 0.5 percent by weight of tris(hydroxymethyl) aminomethane obtained from Aldrich Chemical Company, 0.35 percent by weight of EDTA (ethylenediamine tetra acetic acid) obtained from Aldrich Chemical Company, 0.05 percent by weight of DOWICIL 150 biocide obtained from Dow Chemical Company, Midland, Mich., 0.03 percent by weight of polyethylene oxide (molecular weight 18,500) obtained from Union Carbide Company), 35 percent by weight of Projet Cyan 1 dye, obtained from ICI, and 34.285 percent by weight of deionized water.

Magenta: 15.785 percent by weight of sulfolane, 10.0 percent by weight of butyl carbitol, 2.0 percent by weight of ammonium bromide, 2.0 percent by weight of N-cyclohexylpyrollidinone obtained from Aldrich Chemical Company, 0.5 percent by weight of tris(hydroxymethyl) aminomethane obtained from Aldrich Chemical Company, 0.35 percent by weight of EDTA (ethylenediamine tetra acetic acid) obtained from Aldrich Chemical Company, 0.05 percent by weight of DOWICIL 150 biocide obtained from Dow Chemical Company, Midland, Mich., 0.03 percent by weight of polyethylene oxide (molecular weight 18,500) obtained from Union Carbide Company, 25 percent by weight of Projet magenta 1T dye obtained from ICI, 4.3 percent by weight of Acid Red 52 obtained from Tricon Colors, and 41.985 percent of deionized water.

Yellow: 15.785 percent by weight of sulfolane, 10.0 percent by weight of butyl carbitol, 2.0 percent by weight of ammonium bromide, 2.0 percent by weight of N-cyclohexylpyrollidinone obtained from Aldrich Chemical Company, 0.5 percent by weight of tris(hydroxymethyl) aminomethane obtained from Aldrich Chemical Company, 0.35 percent by weight of EDTA (ethylenediamine tetra acetic acid) obtained from Aldrich Chemical Company, 0.05 percent by weight of DOWICIL 150 biocide obtained from Dow Chemical Company, Midland, Mich., 0.03 percent by weight of polyethylene oxide (molecular weight 18,500) obtained from Union Carbide Company, 27.0 percent by weight of Projet yellow 1G dye, obtained from ICI, 20.0 percent by weight of Acid Yellow 17 obtained from Tricon Colors, and 22.285 percent by weight of deionized water.

The images resulting had a gloss value of 90, an optical density value of 2.05 (black), 1.37 (magenta), 1.60 (cyan), 0.90 (yellow) before washing and 1.85 (black), 1.30 (magenta), 1.55 (cyan) 0.90 (yellow), after washing at 50° C. for two minutes which translates into waterfastness values of 90 percent for the (black) ink, 97 percent for the (cyan) ink, 95 percent for the (magenta) ink, and 100 percent for the (yellow) ink. The optical density of these images after 72 hours in a Mark V Lightfastness Tester [equivalent to three months of Sunshine] were measured at 2.00 (black), 1.35 (magenta), 1.58 (cyan) and 0.88 (yellow), which translates into lightfastness values of 97.5 percent for black ink, 98.5 for the magenta ink, 98.75 for the cyan ink, and 100 percent for the yellow ink. The high image quality obtained on these coated photographic papers was evidenced by their low edge raggedness values of 0.12 millimeter (between black and yellow), 0.20 millimeter (between cyan and yellow), 0.18 millimeter (between magenta and yellow), and 0.30 millimeter (between magenta and cyan).

In comparison, an uncoated Xerox 4024 paper printed with the above same inks, yielded images with poor resolution as evidenced by the optical density values thereof of 1.30 (black), 1.1 (magenta), 1.15 (cyan), 0.75 (yellow), before washing, and 0.91 (black), 0.75 (magenta), 0.75 (cyan), 0.67 (yellow), after washing at 50° C. for two minutes which translates into waterfastness values of 70 percent for the black ink, 68.2 percent for the magenta ink, 65.2 percent for the cyan ink, and 90 percent for the yellow ink. The optical density of these images after 72 hours in a Mark V Lightfastness Tester [equivalent to three months of Sunshine] were measured at 1.00 (black), 0.85 (magenta), 0.80 (cyan), and 0.70 (yellow), which translates into lightfastness values of 76.9. percent for black ink, 77.2 for the magenta ink, 69.6 percent for the cyan ink, and 93.3 percent for the yellow ink. The edge raggedness values for an uncoated Xerox 4024 paper printed with the above same inks were, however, higher at 2.0 millimeters (between black and yellow), 0.95 millimeter (between cyan and yellow), 0.40 millimeter (between magenta and yellow), and 0.85 millimeter (between magenta and cyan).

EXAMPLE II

Coated ink jet photographic papers were prepared by the solvent extrusion process (single side each time initially) on a Faustel Coater using a one slot die by providing for each a paper base sheet (roll form) with a thickness of 100 microns with a Hercules size value of 400 seconds, porosity of 100 mil/minute, and coating the base sheets with a composition comprised of 30.0 parts by weight of the hydrophilic binder diethylammonium chloride hydroxyethylcellulose, available as Celquat H-100, L-200, National Starch and Chemical Company), 20 parts by weight of the ink wetting agent glycerol propoxylate-b-ethoxylate triol (Aldrich #37,386-9); 10.0 parts by weight of the flavor imparting grape and honey flavor compound methyl anthranilate (Aldrich #23,645-4), 24.0 parts by weight of the dye mordant quaternary acrylic copolymer latex polymethyl acrylate trimethyl ammonium chloride latex, HX42-1 available from Interpolymer Corporation, 3.0 parts by weight of the UV absorber poly[N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich Chemical Company), 1.0 part by weight of the biocide N-α-(1-nitroethyl benzyl ethylene diamine) (Metasol J-26, available from Calgon Corporation); and 2.0 parts by weight of the antioxidant ditetradecyl-3,3'-thiodipropionate, available as Cyanox, MTDP, #41,312-7, from Aldrich Chemical Company, 10.0 parts by weight of the filler Eccospheres MC-37 (sodium borosilicate glass), present in a concentration of 10 percent by weight in water. Subsequent to air drying at 100° C. and monitoring the difference in weight prior to and subsequent to coating, the dried paper base sheet rolls contained 1.0 gram, 11 microns in thickness, of the ink receiving layer.

Rewinding the coated side of the paper base sheet (roll form) on to an empty core and using these rolls, the uncoated side of the paper base sheets were coated with a blend comprised of 24.0 parts by weight of urea-formaldehyde resin BC777 available from British Industrial Photographics Limited, 20.0 parts by weight of the antistatic agent quaternary acrylic copolymer latex polymethyl acrylate trimethyl ammonium chloride latex, HX42-1 available from Interpolymer Corporation, 3.0 parts by weight of the UV absorbing compound poly[N,N-bis(2,2,6,6-tetramethyl-4-piperidinyl)-1,6-hexane diamine-co-2,4-dichloro-6-morpholino-1,3,5-triazine) (Cyasorb UV-3346, #41,324-0, available from Aldrich Chemical Company), and 2.0 parts by weight of the antioxidant ditridecyl-3,3'-thiodipropionate, available as Cyanox 711, #41,311-9, from Aldrich Chemical Company, and 1.0 part by weight of the biocide methylene bis(thio cyanate) (Metasol T-10 available from Calgon Corporation); 2.0 parts by weight of didodecyl 3,3'-thiodipropionate, and 40.0 parts by weight of colloidal silica, Syloid 74 available from W. R. Grace and Company, 10.0 parts by weight of zirconium oxide (SF-EXTRA available from Z-Tech Corporation), present in a concentration of 10 percent by weight in water. Subsequent to air drying at 100° C. and monitoring the difference in weight prior to and subsequent to coating, the dried paper base sheet rolls contained 1.0 gram, 11 microns in thickness, of the above pigmented coating. The coated ink jet photographic papers were cut from this roll in 8.5 by 11.0 inch cut sheets.

Preparation of the Ink Jet Images on the Coated Ink Jet Photographic Papers

The coated ink jet photographic papers prepared were incorporated into a Hewlett-Packard 500-C color ink jet printer containing inks of the same composition as those of Example I. Images were generated with optical density values of 1.40 (cyan), 1.27 (magenta), 0.85 (yellow), and 2.05 (black).

These images had gloss value of 85, optical density values of 1.95 (black), 1.20 (magenta), 1.35 (cyan), 0.85 (yellow), after washing at 50° C. for two minutes which translates into waterfastness values of 95 percent for the (black) ink, 96.5 percent for the (cyan) ink, 94.5 percent for the (magenta) ink, and 100 percent for the (yellow) ink. The optical density of these images after 72 hours in a Mark V Lightfastness Tester [equivalent to three months of Sunshine] were measured at 2.00 (black), 1.25 (magenta), 1.38 (cyan), and 0.85 (yellow), which translates into lightfastness greater than 97.5 percent for all inks. The high image quality obtained on these coated photographic papers was evidenced by low edge raggedness values of 0.16 millimeter (between black and yellow), 0.23 millimeter (between cyan and yellow), 0.20 millimeter (between magenta and yellow), and 0.35 millimeter (between magenta and cyan).

In comparison, an uncoated Xerox 4024 paper printed with the above same inks, provided poor resolution images with optical density values of 1.30 (black), 1.1 (magenta), 1.15 (cyan), 0.75 (yellow), before washing, and 0.91 (black), 0.75 (magenta), 0.75 (cyan) 0.67 (yellow), after washing at 50° C. for two minutes which translates into waterfastness values of 70 percent for the black ink, 68.2 percent for the magenta ink, 65.2 percent for the cyan ink, and 90 percent for the yellow ink. The optical density of these images after 72 hours in a Mark V Lightfastness Tester [equivalent to three months of 24 hour Sunshine] were measured at 1.00 (black), 0.85 (magenta), 0.80 (cyan) and 0.70 (yellow), which translates into lightfastness values of 76.9. percent for black ink, 77.2 for the magenta ink, 69.6 percent for the cyan ink, and 93.3 percent for the yellow ink. The edge raggedness values were, however, higher at 2.0 millimeters (between black and yellow), 0.95 millimeter (between cyan and yellow), 0.40 millimeter (between magenta and yellow), and 0.85 millimeter (between magenta and cyan).

Other embodiments and modifications of the present invention may occur to those skilled in the art subsequent to a review of the information presented herein; these embodiments and modifications, as well as equivalents thereof, are also included within the scope of this invention.

What is claimed is:

1. A coated ink jet paper comprised of (1) a cellulosic substrate; (2) a first ink receiving layer coating on the front, or first side of the substrate capable of absorbing an ink vehicle and which receiving layer coating is comprised of (a) a hydrophilic binder polymer, (b) an ink spreading/ink wetting agent, (c) a flavor imparting compound, (d) a dye mordant, (e) a lightfastness agent, (f) a filler, and (g) a biocide; and (3) a second traction controlling layer coating in contact with the reverse side, backside or second side of the substrate and which coating is comprised of (a) a polymer with a glass transition temperature of from about a −50° C. to about 50° C., (b) an antistatic agent, (c) a lightfastness agent, (d) a filler, and (e) a biocide.

2. A coated ink jet paper in accordance with claim 1 wherein the cellulosic substrate is comprised of alkaline sized and acid sized blends of hardwood kraft and softwood kraft fibers, which blends contain from about 20 percent to 80 percent by weight of softwood and from about 80 to about 20 percent by weight of hardwood.

3. A coated ink jet paper in accordance with claim 2 wherein the sizing value of the cellulosic substrate is from between about 50 seconds and about 500 seconds, the porosity is from about 100 to about 600 mil/minute, and the thickness is from about 50 microns to about 250 microns.

4. A coated ink jet paper in accordance with claim 1 wherein the hydrophilic polymeric binder is present in amounts of from about 5 parts by weight to about 70 parts by weight, and which binders are selected from the group consisting of (0.5) polysaccharides (1) starch, (2) cationic starch, (3) hydroxypropyl starch, (4) hydroxyethyl starch, (5) gelatin, (6) methyl cellulose, (7) benzyl cellulose, (8) phenyl cellulose, (9) hydroxyethyl cellulose, (10) hydroxypropyl cellulose, (11) ethyl hydroxyethyl cellulose, (12) hydroxyethyl methyl cellulose, (13) hydroxy propyl methyl cellulose, (14) hydroxy butylmethyl cellulose, (15) dihydroxypropyl cellulose, (16) hydroxypropyl hydroxyethyl cellulose, (17) chloro deoxy cellulose, (18) amino deoxy cellulose, (19) diethylammonium chloride hydroxyethyl cellulose, (20) hydroxypropyl trimethyl ammonium chloride hydroxyethyl cellulose, (21) DEAE cellulose, (22) carboxymethyl dextrans, (23) diethyl aminoethyl dextran, (24) amino dextran, (25) sodium carboxymethyl cellulose, (26) gum arabic, (27) carrageenan, (28) Karaya gum, (29) xanthan, (30) chitosan, (31) carboxymethyl hydroxypropyl guar, (32) cationic guar, (33) n-carboxymethyl chitin, (34) dimethyl ammonium hydrolyzed collagen protein, (35) agar-agar, (36) sodium cellulose sulfate, and (37) sodium carboxymethyl hydroxyethyl cellulose.

5. A coated paper in accordance with claim 4 wherein said binder is present in an amount of from about 16 to about 70 parts by weight.

6. A coated ink jet paper in accordance with claim 1 wherein the hydrophilic polymeric binder is present in amounts of from about 5 parts by weight to about 70 parts by weight, and which binder is selected from the group consisting of (1) poly(vinyl alcohol), (2) poly(vinyl phosphate), (3) poly(vinyl pyrrolidone), (4) vinyl pyrrolidone-vinyl acetate copolymers, (5) vinyl pyrrolidone-styrene copolymers, (6) poly(vinylamine), (7) poly(vinyl alcohol) ethoxylated, (8) poly(vinyl pyrrolidone-diethylaminomethylmethacrylate), (9) vinyl alcohol-vinyl acetate copolymer, (10) vinyl alcohol-vinylbutyral copolymer, (11) melamine-formaldehyde resin, (12) urea-formaldehyde resin, (13) methylated urea-formaldehyde resins, (14) poly(2-acrylamide-2-methyl propane sulfonic acid), (15) poly(N,N-dimethyl-3,5-dimethylenepiperidiniumchloride), (16) poly(methylene-guanidine)hydrochloride, (17) styrene-butadiene latexes, (18) ethylene-vinylacetate latex, (19) vinyl acetate-acrylic copolymer latexes, (20) polyester latexes, (21) vinyl methyl ether-maleic anhydride copolymer, (22) ethylene-maleic anhydride copolymer, (23) butadiene-maleic acid copolymers, (24) vinylmethylether-maleic acid copolymer, (25) methyl vinyl ether-maleic acid ester, (26) poly (acrylamide), (27) acrylamide-acrylic acid copolymers, (28) poly(N,N-dimethyl acrylamide), (29) poly(ethylene imine), (30) poly(ethylene imine) epichlorohydrin; and (31) ethoxylated poly imine.

7. A coated ink jet paper in accordance with claim 1 wherein the ink spreading/ink wetting agent is a hydrophilicpolyoxyalkylene present in amounts of from about 25 parts by weight to about 1 part by weight, and which agent is selected from the group consisting of (1) poly(ethylene oxide), (2) ethyleneoxide/propyleneoxide copolymers, (3) ethyleneoxide/2-hydroxyethyl methacrylate/ethyleneoxide, (4) ethyleneoxide/hydroxypropylmethacrylate/ethylene oxide triblock copolymers, (5) ionene/ethyleneoxide/ionene triblock copolymers, (6) ethyleneoxide/isoprene/ethyleneoxide triblock copolymers, (7) epichlorohydrin-ethylene oxide copolymer, and mixtures thereof.

8. An ink jet paper in accordance with claim 7 wherein mixtures thereof are comprised of two components, the first being present in an amount of from about 1 to about 99 weight percent, and the second component being present in an amount of from about 99 to about 1 weight percent.

9. A coated paper in accordance with claim 7 wherein said agent is present in an amount of from about 20 to about 2 parts by weight.

10. A coated ink jet paper in accordance with claim 1 wherein the ink spreading/ink wetting agent is an alcohol present in amounts of from about 25 parts by weight to about 1 part by weight, and which alcohol is selected from the group consisting of (1) trimethylolpropane, (2) trimethylolpropane ethoxylate, (3) trimethylolpropane triacrylate, (4) trimethylolpropane trimethacrylate, (5) trimethylolpropane ethoxylate triacrylate, (6) trimethylolpropane propoxylate triacrylate, (7) trimethylolpropane ethoxylate methylether diacrylate, (8) trimethylolpropane tris(2-methyl-1-aziridinepropionate), (9) neopentyl glycol ethoxylate, (10) neopentyl glycol propoxylate, (11) glycerol propoxylate, (12) glycerol propoxylate-b-ethoxylate triol, (13) glycerol ethoxylate-b-propoxylate triol, (14) pentaerythritol ethoxylate, (15) pentaerythritol propoxylate, (16) pentaerythritol propoxylate ethoxylate, (17) triethanol amine ethoxylate, (18) N-methyl diethanolamine, (19) N-ethyl diethanolamine, (20) N-butyl diethanolamine, (21) N-phenyl diethanolamine, (22) triethanol amine, (23) trioctylamine, (24) 4-xylylene diamine, (25) 1,4-bis(2-hydroxyethoxy)-2-butyne, (26) pantothenol, (27) 1-phenyl-1,2-ethanediol, (28) 3-methoxy-1,2-propanediol, (29) 3-allyloxy-1,2-propanediol, (30) 3-ethoxy-1,2-propanediol, (31) 3-phenoxy-1,2-propanediol, (32) 3-octadecyloxy-1,2-propanediol, (33) 3-(4-methoxy phenoxy)-1,2-propanediol, (34) [3-(2-methyl phenoxy)-1,2-propanediol], (35) 3-amino-1,2-propanediol, (36) 3-(diethylamino)-1,2-propanediol, (37) 2-phenyl-1,2-propanediol, (38) 3-(diisopropyl amino)-1,2-propanediol, (39) 3-(N-benzyl-N-methylamino)-1,2-propanediol, (40) 3-pyrrolidino-1,2-propanediol, (41) 3-piperidino-1,2-propanediol, (42) 3-morpholino-1,2-propanediol, (43) 2,2-dimethyl-1-phenyl-1,3-propanediol, (44) 2-benzyloxy-1,3-propanediol, (45) 4-8-bis(hydroxymethyl)tricyclo[5.2.1.02.6]decane, (46) 1-[N,N-bis(2-hydroxy ethyl) isopropanol amine, (47) N,N-bis(2-hydroxypropyl)ethanol amine, (48) 1-[2-(2-hydroxyethoxy) ethyl]-piperazine, (49) 1-4-bis(2-hydroxyethyl)piperazine, (50) homo vanillyl alcohol, (51) phenethyl alcohol, (52) 3,6-dimethyl-4-octyne-3,6-diol, (53) 2-(hydroxymethyl)-1,3-propanediol, (54) 2-butyl-2-ethyl-1,3-propanediol, (55) 2-piperidine methanol, (56) 2,2,4-trimethyl-1,3-pentanediol, (57) vitamin E, (58) vitamin E acetate, (59) vitamin K, (60) tri(ethylene glycol) dimethylacrylate, (61) triethyl citrate, (62) 2,4,7,9-tetramethyl-5-decyne-4,7-diol; and mixtures thereof.

11. A coated ink jet paper in accordance with claim 1 wherein the flavor imparting compound of the first coating is present in amounts of from about 20 parts by weight to about 1 part by weight, and which compound is selected from the group consisting of (1) isoamylacetate, (2) ethyl-2-methyl butyrate, (3) n-hexanal, (4) damascenone, (5) muscone, (6) ethylene brassylate, (7) ethylenedodecanedioate, (8) eremophilone, (9) anethole, (10) isobutyl-2-butenedioate, (11) 2,5-dimethyl-4-hydroxy-3(2H)-furanone, (12) carvone, (13) benzaldehyde, (14) tolylaldehyde, (15) benzylacetate, (16) 5-methyl-2-phenyl-2-hexenal, (17) isoamyl butyrate, (18) vanilin, (19) isoamyl phenyl acetate, (20) 2-methoxy-5-methyl pyrazine, (21) cinnamic aldehyde, (22) furfuryl mercaptan, (23) furfuryl thiopropionate, (24) γ-nonalactone, (25) ethyloenanthate, (26) 2-methyl-2-pentenoic acid, (27) methyl anthranilate, (28) ethyl-3-hydroxy butyrate, (29) nootkatone, (30) methyl (methylthio)pyrazine, (31) benzylacetate, (32) indole, (33) citral, (34) α-terpineol, (35) β-sinensal, (36) ethyl anthranilate, (37) thymol, (38) octylaldehyde, (39) decyl aldehyde, (40) 2-methyl-3-ρ-tolyl propionaldehyde, (41) hydroxy citronellal dimethyl acetal, (42) 2,6-dimethyl-5-heptenal, (43) 2-phenylpropionaldehyde, (44) 2-methyl-3-(4-isoproyl phenyl) propionaldehyde, (45) 3-methyl-1,2-cyclopentanedione, (46) menthol, (47) 3-methylthio-1-hexanol, (48) γ-undeca lactone, (49) 6-amyl-α-pyrone, (50) 2,5-dimethylpyrazine, (51) ethyldecane-cis-4-trans-2-dienoate, (52) allylcaproate, (53) methyl β-methyl thiopropionate, (54) allyl cyclohexane propionate, (55) 6-methyl-α-ionone, (56) trans-α-ionone, (57) 4-(4-hydroxyphenyl)-2-butanone, (58) ethylmaltol, (59) methyl cinnamate, (60) 4-hydroxy-2,5-dimethyl-3(2H)-furanone, (61) ethylmethyl phenyl glycidate, (62) ethylvanilin, (63) propenyl quaethol, and mixtures thereof.

12. A coated ink jet paper in accordance with claim 1 wherein the dye mordant of the first layer coating layer is a cationic mordant, and which dye mordant is present in amounts of from about 33 parts by weight to about 1 part by weight and is selected from the group consisting of (1) ammonium quaternary salts, (2) phosphonium quaternary salts, (3) sulfonium quaternary salts, (4) thiazolium quaternary salt, (5) benzothiazolium quaternary salts, and (6) mixtures thereof.

13. A coated ink jet paper in accordance with claim 1 wherein the lightfastness agent of the first layer is present in amounts of from about 12 parts by weight to about 1 part by weight, and is selected from the group consisting of (1) UV absorbing compounds, (2) antioxidants, (3) antiozonants, and (4) mixtures thereof.

14. A coated ink jet paper in accordance with claim 1 wherein the filler component of the first layer coating composition is present in amounts of from about 1 part by weight to about 25 parts by weight, and is selected from the group consisting of (1) microspheres of sodium borosilicate glass, (2) microspheres of soda lime glass, (3) microspheres of phenolic polymers, (4) vinylidene chloride-acrylonitrile microspheres, (5) hollow composite microspheres of polyvinylidene chloride/acrylonitrile copolymer shell 15 percent by weight and calcium carbonate 85 percent by weight, (6) stearate coated calcium carbonate, (7) sodium metasilicate anhydrous, (8) sodium metasilicate pentahydrate, (9) organophilic montmorillonitrile clay, (10) magnesium aluminum silicate, (11) magnesium carbonate, (12) magnesium oxide, (13) zirconium oxide, (14) colloidal silicas, (15) titanium dioxide, (16) hydrated alumina, (17) barium sulfate, (18) calcium carbonate, (19) high brightness clays, (20) calcium silicate, (21) blends of calcium fluoride and silica, (22) zinc oxide, (23) blends of zinc sulfide with barium sulfate, (24) barium titanate, (25) brightener fluorescent pigments of coumarin derivatives, (26) fluorescent pigments of oxazole derivatives, (27) antimony oxide; and mixtures thereof.

15. A coated ink jet paper in accordance with claim 1 wherein the total thickness of the first coating layer is from about 0.1 to about 25 microns.

16. A coated ink jet paper in accordance with claim 1 wherein in the first layer coating composition, the binder is present in amounts of from about 16 parts by weight to about 70 parts by weight, the ink spreading agent is present in an amount of from about 20 parts by weight to about 2 parts by weight, the flavor imparting compound is present in an amount of from about 20 parts by weight to about 2 parts by weight, the dye mordant is present in an amount of from about 30 parts by weight to about 3 parts by weight, the lightfastness inducing agent is present in amounts of from about 10 parts by weight to about 2 parts by weight, the filler is present in amounts of from about 1 part by weight to about 20 parts by weight,and the biocide compound is present in amounts of from about 3 parts by weight to about 1 part by weight.

17. A coated ink jet paper in accordance with claim 1 wherein the polymeric binder of the second layer with a glass transition temperature of from about −50° C. to about 50° C. is a water soluble/dispersible binder selected from the group consisting of (1) melamine-formaldehyde resin, (2) urea-formaldehyde resin, (3) alkylated urea-formaldehyde resins, (4) vinyl methyl ether-maleic anhydride copolymer, (5) ethylene-maleic anhydride copolymers, (6) butadiene-maleic acid copolymers, (7) octadecene-1-maleic anhydride copolymer (8) polyvinylmethylether (9) vinylmethylether-maleic acid copolymer, (10) methyl vinyl ether-maleic acid ester, (11) neoprene latex, and (12) acrylic emulsion latex.

18. A coated ink jet paper according to claim 1 wherein in the second layer coating composition the polymer/binder is present in amounts of from about 70 parts by weight to about 14 parts by weight, the antistatic agent is present in an amount of from about 20 parts by weight to about 3 parts by weight, the lightfastness agent is present in amounts of from about 6 parts by weight to about 2 parts by weight, the filler is present in amounts of from about 1 part by weight to about 80 parts by weight, and the biocide compound is present in amounts of from about 3 parts by weight to about 1 part by weight, and wherein the total thickness of the second coating layer is from about 0.1 to about 25 microns.

19. A coated ink jet paper according to claim 1 wherein the first ink receiving coating on the first side of the substrate is comprised of (1) the hydrophilic binders hydroxypropyl cellulose and diethylammonium chloride hydroxyethylcellulose, (2) the ink spreading/ink wetting agent is glycerol propoxylate-b-ethoxylate triol, or polyethylene oxide, (3) the flavor imparting compound is methyl anthranilate, or γ-undecalactone, (4) the dye mordant is a quaternary polymethyl acrylate trimethyl ammonium chloride latex, or quaternary ammonium block copolymers, (5) the lightfastness agent is comprised of the UV absorber poly[N,N-bis(2,2,6,6-tetramethyl-4-piperidinyl)-1,6-hexanediamine-co-2,4-dichloro-6-morpholino-1,3,5-triazine), the antioxidant didodecyl-3,3'-thiodipropionate, and the antiozonant N,N'-di(2-octyl)-ρ-phenylene diamine, (6) filler is a glass sphere of sodium boro silicate glass, or colloidal silica, (7) the biocide is 2-hydroxy propylmethane thiosulfonate, or N-α-(1-nitroethyl benzyl ethylene diamine), and the second traction controlling coating in contact with the second side of the substrate is comprised of (1) the hydrophilic binder of a urea-formaldehyde resin, or polyvinyl alcohol ethoxylated, (2) the antistatic agent is a quaternary acrylic copolymer latex, a polymethyl acrylate trimethyl ammonium chloride latex, or a quaternary ammonium salt, (3) the lightfastness agent is comprised of the UV absorber 2-(4-benzoyl-3-hydroxyphenoxy)ethylacrylate, the antioxidant ditridecyl-3,3'-thio dipropionate, and the antioxidant ditetradecyl-3,3'-thiodipropionate, or the antiozonant N-(1,3-dimethylbutyl)-N'-phenyl-phenylenediamine, (4) the filler is a fluorescent pigment of oxazole derivatives, or zirconium oxide, (5) the biocide is methylene bis(thio cyanate), or a cationic poly(oxyethylene (dimethylamino)-ethylene(dimethylamino)ethylene dichloride).

20. A coated ink jet paper in accordance with claim 1 wherein the first ink receiving coating on the first side of the substrate has a thickness of from about 0.1 to about 25 microns and is comprised of the hydrophilic binder polymer present in amounts of from about 5 parts by weight to about 70 parts by weight, the ink spreading/ink wetting agent is present in amounts of 25 parts by weight to about 1 part by weight, the dye mordant is present in an amount of from about 33 parts by weight to about 1 part by weight, the lightfast agent is present in amounts of from about 12 parts by weight to about 1 part by weight, the filler is present in amounts of from about 1 part by weight to about 25 parts by weight, and the biocide compound is present in amounts of from about 3 parts by weight to about 1 part by weight; and the second traction controlling coating in contact with the reverse side of the substrate has a thickness of from about 0.1 to about 25 microns and is comprised of a hydrophilic binder present in amounts of from about 70 parts by weight to about 7 parts by weight, the antistatic agent is present in an amount of from about 20 parts by weight to about 1 part by weight, the lightfastness agent is present in amounts of from about 6 parts by weight to about 1 part by weight, the filler is present in amounts of from about 1 part by weight to about 90 parts by weight and the biocide is present in amounts of from about 3 parts by weight to about 1 part by weight.

21. A coated ink jet paper in accordance with claim 1 wherein the first ink receiving coating on the front side of the substrate has a thickness of from about 0.5 to about 20 microns and is comprised of the binder present in amounts of from about 16 parts by weight to about 70 parts by weight, the ink spreading agent is present in an amount of from about 20 parts by weight to about 2 parts by weight, the flavor imparting compound is present in an amount of from about 20 parts by weight to about 2 parts by weight, the dye mordant is present in an amount of from about 30 parts by weight to about 3 parts by weight, the lightfastness agent is present in amounts of from about 10 parts by weight to about 2 parts by weight, the filler is present in amounts of from about 1 part by weight to about 20 parts by weight, and the biocide compound is present in amounts of from about 3 parts by weight to about 1 part by weight; and the second traction coating in contact with the reverse side of the substrate has a thickness of from about 0.5 to about 20 microns and is comprised of a binder present in amounts of from about 70 parts by weight to about 14 parts by weight, the antistatic agent is present in an amount of from about 20 parts by weight to about 3 parts by weight, the lightfastness agent is present in amounts of from about 6 parts by weight to about 2 parts by weight, the filler is present in amounts of from about 1 part by weight to about 80 parts by weight, and the biocide compound is present in amounts of from about 3 parts by weight to about 1 part by weight.

22. A printing process which comprises incorporating into an ink jet printing apparatus containing an aqueous ink a coated paper which comprises (1) a cellulosic substrate; (2) a first ink receiving coating on the front side of the substrate capable of absorbing an ink vehicle, and which receiving layer coating is comprised of (a) a hydrophilic binder polymer, (b) an ink wetting/ink spreading agent, (c) a flavor imparting compound, (d) a dye mordant, (e) a lightfastness agent, (f) a filler, and (g) a biocide; and (3) a second traction controlling coating in contact with the reverse side, or back side of the substrate, and which coating is comprised of (a) a polymer with a glass transition temperature of from about a −50° C. to about 50° C., (b) an antistatic agent, (c) a lightfastness agent, (d) a filler, and (e) a biocide; and causing droplets of the ink to be ejected in an imagewise pattern onto the coated paper, thereby generating images on the coated paper.

23. A printing process in accordance with claim 20 wherein the printing apparatus employs a thermal ink jet process wherein the ink in the nozzles is selectively heated in an imagewise pattern, thereby causing droplets of the ink to be ejected in imagewise pattern, and wherein the recorded images possess an optical density of from about 2.0 to about 2.05 for a black ink, between about 1.4 to about 1.60 for a cyan ink, between about 1.25 to about 1.37 for a magenta ink, between about 0.85 to about 0.9 for a yellow ink, with lightfastness values of from about 97.5 to about 100 percent for all inks; waterfastness values from about 90 to about 100 percent for all inks, and low edge raggedness values of about 0.12 millimeter (between black and yellow), about 0.20 millimeter (between cyan and yellow), about 0.18 millimeter (between magenta and yellow), and about 0.30 millimeter (between magenta and cyan).

24. A paper comprised of (1) a substrate; (2) a first ink receiving layer on the first side of the substrate, and which receiving layer coating is comprised of (a) hydrophilic binder polymer, (b) ink spreading/ink wetting agent, (c) flavor imparting compound, (d) dye mordant, (e) lightfastness agent, (f) filler, and (g) biocide; and (3) a second traction controlling layer coating in contact with the second side of the substrate, and which coating is comprised of (a) polymer with a glass transition temperature of from about −50° C. to about 50° C., (b) antistatic agent, (c) lightfastness agent, (d) filler, and (e) biocide.

25. A paper in accordance with claim 24 wherein said glass transition temperature is from about −25° C. to about +25° C.

* * * * *